US009335676B2

(12) United States Patent
Miyagawa et al.

(10) Patent No.: US 9,335,676 B2
(45) Date of Patent: May 10, 2016

(54) IMAGE FORMING APPARATUS

(71) Applicants: Hiroaki Miyagawa, Ibaraki (JP); Tomoyasu Hirasawa, Kanagawa (JP); Keisuke Ikeda, Kanagawa (JP); Susumu Tateyama, Ibaraki (JP); Kenji Ishii, Ibaraki (JP)

(72) Inventors: Hiroaki Miyagawa, Ibaraki (JP); Tomoyasu Hirasawa, Kanagawa (JP); Keisuke Ikeda, Kanagawa (JP); Susumu Tateyama, Ibaraki (JP); Kenji Ishii, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/276,067

(22) Filed: May 13, 2014

(65) Prior Publication Data

US 2014/0334858 A1 Nov. 13, 2014

(30) Foreign Application Priority Data

May 13, 2013 (JP) ..... 2013-101483

(51) Int. Cl.
*G03G 15/20* (2006.01)

(52) U.S. Cl.
CPC ..... *G03G 15/2017* (2013.01); *G03G 15/2021* (2013.01); *G03G 15/205* (2013.01); *G03G 2215/00421* (2013.01); *G03G 2215/0129* (2013.01)

(58) Field of Classification Search
CPC ..... G03G 15/2017; G03G 15/2021; G03G 15/205; G03G 2215/00421
USPC ..... 399/341
See application file for complete search history.

(56) References Cited

U.S. PATENT DOCUMENTS

| | | | | |
|---|---|---|---|---|
| 7,865,122 | B2 * | 1/2011 | Koyama et al. | 399/341 |
| 2010/0008695 | A1 | 1/2010 | Okano et al. | |
| 2011/0030927 | A1 * | 2/2011 | Okano et al. | 165/104.33 |
| 2011/0052247 | A1 | 3/2011 | Saitoh et al. | |
| 2011/0052248 | A1 | 3/2011 | Nishimura et al. | |
| 2011/0170895 | A1 | 7/2011 | Fujiya et al. | |
| 2012/0061057 | A1 | 3/2012 | Okano et al. | |

(Continued)

FOREIGN PATENT DOCUMENTS

| | | |
|---|---|---|
| JP | 2007-133174 | 5/2007 |
| JP | 2012-098677 | 5/2012 |
| JP | 2014-206614 | 10/2014 |

OTHER PUBLICATIONS

U.S. Appl. No. 14/140,854, filed Dec. 26, 2013.

(Continued)

*Primary Examiner* — David Gray
*Assistant Examiner* — Tyler Hardman
(74) *Attorney, Agent, or Firm* — Oblon, McClelland, Maier & Neustadt, L.L.P

(57) ABSTRACT

An image forming apparatus includes a cooling conveyor to cool a recording material having an image fixed by heat while sandwiching and conveying the recording material. The cooling conveyor includes a conveyance belt, a cooling member, and a cooling unit. The conveyance belt sandwiches and conveys the recording material. The cooling member absorbs heat of the recording material via the conveyance belt. The cooling unit maintains the cooling member at low temperature. The cooling conveyor performs control of stopping the cooling unit in a standby state of the image forming apparatus, activating the cooling unit and performing a preliminary cooling operation to decrease temperature of the cooling member after a shift from the standby state to image forming operation, and then bringing the recording material into contact with the conveyance belt.

14 Claims, 14 Drawing Sheets

(56) References Cited

U.S. PATENT DOCUMENTS

| | | | | |
|---|---|---|---|---|
| 2012/0070180 | A1 | 3/2012 | Iijima et al. | |
| 2012/0227927 | A1 | 9/2012 | Fujiya et al. | |
| 2012/0263491 | A1 | 10/2012 | Fujiya et al. | |
| 2012/0315069 | A1* | 12/2012 | Ikeda | G03G 15/0189 399/341 |
| 2013/0177332 | A1* | 7/2013 | Saito | G03G 15/2021 399/92 |
| 2013/0259512 | A1* | 10/2013 | Ikeda et al. | 399/94 |
| 2014/0044462 | A1* | 2/2014 | Ikeda et al. | 399/341 |
| 2014/0060782 | A1* | 3/2014 | Ikeda et al. | 165/104.26 |
| 2014/0186080 | A1* | 7/2014 | Ikeda et al. | 399/341 |
| 2014/0186081 | A1* | 7/2014 | Hirasawa et al. | 399/341 |
| 2014/0233996 | A1* | 8/2014 | Ikeda et al. | 399/341 |
| 2014/0270877 | A1* | 9/2014 | Tomino | 399/341 |
| 2014/0308057 | A1* | 10/2014 | Tomino | G03G 15/6573 399/341 |
| 2014/0308058 | A1* | 10/2014 | Ikeda et al. | 399/341 |

OTHER PUBLICATIONS

U.S. Appl. No. 14/140,888, filed Dec. 26, 2013.
U.S. Appl. No. 14/182,734, filed Feb. 18, 2014.

* cited by examiner

IMAGE FORMING APPARATUS

CROSS-REFERENCE TO RELATED APPLICATIONS

This patent application is based on and claims priority pursuant to 35 U.S.C. §119(a) to Japanese Patent Application No. 2013-101483, filed on May 13, 2013, in the Japan Patent Office, the entire disclosure of which is hereby incorporated by reference herein.

BACKGROUND

1. Technical Field

Embodiments of this disclosure relate to an image forming apparatus including a cooling conveyor to cool a sheet-type recording material, such as a sheet of paper, having an image fixed thereon by heat while sandwiching and conveying the recording material with a conveyance belt(s).

2. Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. Such electrophotographic image forming apparatuses typically have a fixing device to heat a toner image borne on a recording material (e.g., a sheet of paper) to fix the toner image on the recording material. Such recording materials having toner images fixed thereon may be stacked on an output tray of the image forming apparatus.

In such a case, the recording materials having toner images are stacked one on another in heated state. As a result, toner is softened by heat retained in the stacked recording materials, and pressure due to the weight of the stacked recording materials may cause the recording materials to adhere to each other with softened toner. If the recording materials adhering to each other are forcefully separated, the fixed toner images might be damaged. Such an adhering state of the stacked recording materials is referred to as blocking. To suppress blocking, a cooling device may be employed to cool a recording material after a toner image is fixed on the recording material by heat.

For example, as a device for cooling a recording material while conveying the recording material, an image forming apparatus has a cooling conveyor including a cooling member to absorb heat of the recording material having an image fixed by heat via a conveyance belt while sandwiching and conveying the recording material with a belt conveyance assembly including the conveyance belt. For example, JP-2012-098677-A describes an image forming apparatus including the following cooling conveyor. The cooling conveyor described in JP-2012-098677-A includes a belt conveyance assembly having conveyance belts to sandwich and convey a recording material and cooling members disposed at inner circumferential sides of the respective conveyance belts to absorb heat of the recording material via the conveyance belts. In addition, the cooling conveyor also has liquid-cooling-type components, such as a radiator serving as a cooling unit to maintain the cooling members at low temperatures. With the cooling conveyor having such a configuration, a recording material is cooled from both of the front and back faces to effectively suppress occurrence of the above-described blocking.

With increased demand for power saving, recently, there has increased the number of image forming apparatus performing the following control. For example, an image forming apparatus controls devices other than, e.g., a controller, to reduce or stop the supply of power in a standby state (hereinafter, during standby), that is, a state in which the image forming apparatus is waiting for a subsequent image formation signal after a certain threshold time has passed from the precedent image forming operation or a state immediately after the image forming apparatus is powered on. For example, JP-2007-133174-A proposes an image forming apparatus that stops, during standby, operation of a cooling fan serving as a cooling unit to adjust the temperature of a fixing device and operation of a heater serving as a heat source of the fixing device. Such control is performed to reduce power supplied to the cooling fan and the heater to cope with demand for power saving. Such control may be performed in an image forming apparatus having a cooling conveyor to cool a recording material having an image fixed by heat while conveying the recording material. Such an image forming apparatus may control the cooling unit and a conveyance belt to be stopped during standby.

BRIEF SUMMARY

In at least one exemplary embodiment of this disclosure, there is provided an image forming apparatus including a cooling conveyor to cool a recording material having an image fixed by heat while sandwiching and conveying the recording material. The cooling conveyor includes a conveyance belt, a cooling member, and a cooling unit. The conveyance belt sandwiches and conveys the recording material. The cooling member absorbs heat of the recording material via the conveyance belt. The cooling unit maintains the cooling member at low temperature. The cooling conveyor performs control of stopping the cooling unit in a standby state of the image forming apparatus, activating the cooling unit and performing a preliminary cooling operation to decrease temperature of the cooling member after a shift from the standby state to image forming operation, and then bringing the recording material into contact with the conveyance belt.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
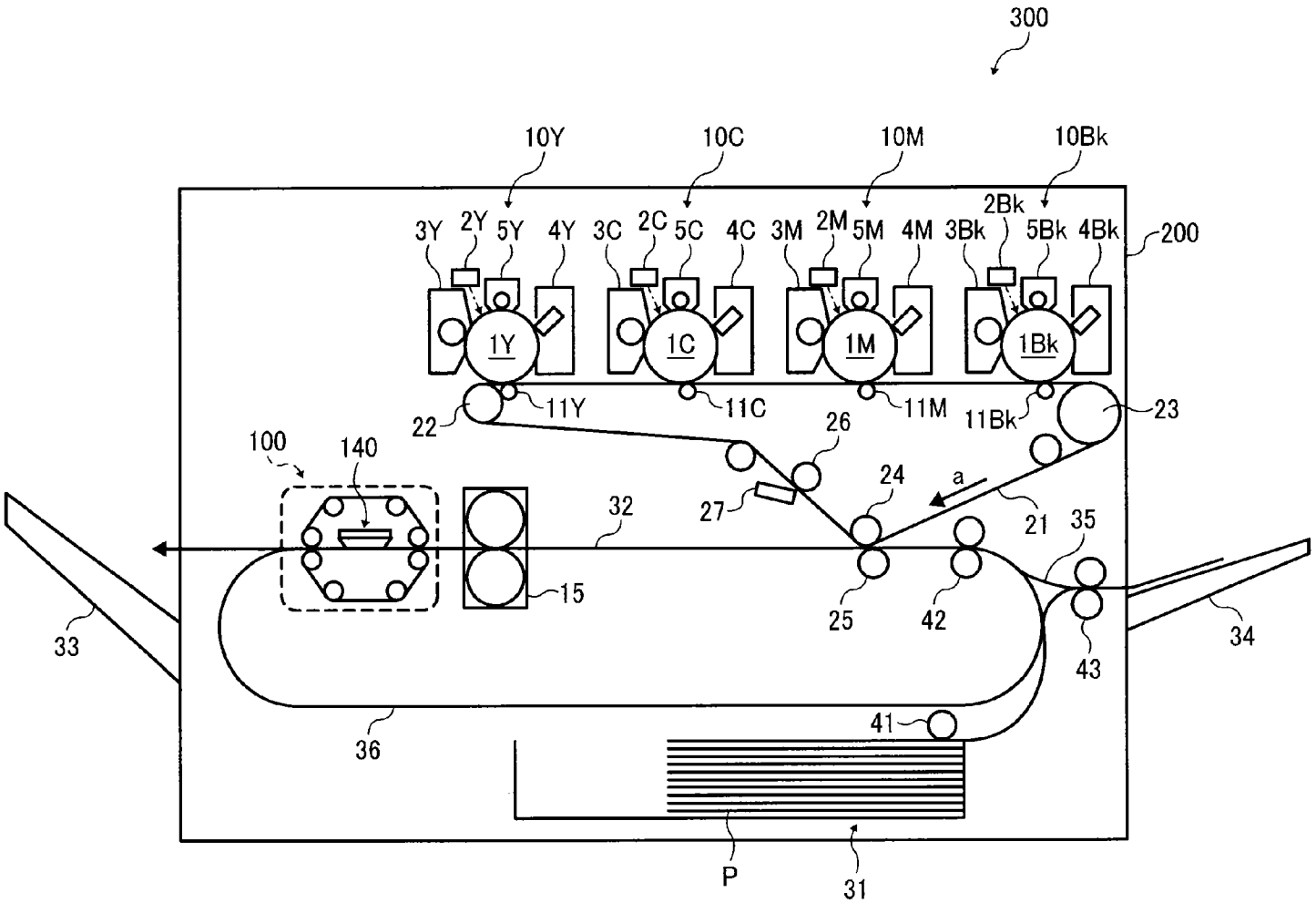
FIG. 1 is a schematic view of an image forming apparatus according to an embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

Below, an image forming apparatus including a cooling conveyor according to an embodiment of this disclosure is described with reference to drawings.

First, an image forming apparatus 300 according to an embodiment of this disclosure is described below.

FIG. 1 is a schematic configuration view of the image forming apparatus 300 according to an embodiment of this disclosure. In FIG. 1, the image forming apparatus 300 is illustrated as a printer. However, in other embodiments, an image forming apparatus is not limited to such a printer and may be any suitable type of image forming apparatus.

As illustrated in FIG. 1, in this embodiment, the image forming apparatus 300 includes an intermediate transfer belt 21 serving as an intermediate transfer member in an apparatus body 200. The intermediate transfer belt 21 is stretched over plural rollers (e.g., a first tension roller 22, a second tension roller 23, and a third tension roller 24). By rotation of one of the plural rollers, the intermediate transfer belt 21 is driven to rotate in a direction indicated by arrow "a" in FIG. 1. For the image forming apparatus 300, process units for image formation are disposed around the intermediate transfer belt 21. Subscripts Y, C, M, and Bk after numeral codes indicate specifications for yellow, cyan, magenta, and black, respectively.

When the rotation direction of the intermediate transfer belt 21 is indicated by arrow "a" in FIG. 1, four imaging stations 10Y, 10C, 10M, and 10Bk serving as process units for image formation corresponding to the respective colors are disposed between the first tension roller 22 and the second tension roller 23 at an upper portion of the intermediate transfer belt 21. The image station 10Y for yellow image, the image station 10C for cyan image, the image station 10M for magenta image, and the image station 10Bk for black image are arranged in this order from an upstream side in a moving direction (surface moving direction) of the intermediate transfer belt 21.

The imaging stations 10Y, 10C, 10M, and 10Bk have substantially the same configuration except for the different toner colors. In each of the image stations 10, a charging device 5, an optical writing device 2, a development device 3, and a photoconductor cleaning device 4 are disposed around a photoconductor 1 having a drum shape. In addition, at a position opposing the photoconductor 1 via the intermediate transfer belt 21 is disposed a primary transfer roller 11 serving as a transfer unit to transfer a toner image onto the intermediate transfer belt 21. The imaging stations 10Y, 10C, 10M, and 10Bk are arranged at certain pitches from each other along the surface moving direction of the intermediate transfer belt 21. The optical writing device 2 exposes each photoconductor 1 in accordance with image information. For the image forming apparatus 1, the optical writing device 2 is, e.g., an optical system using a light emitting diode (LED) as a light source. In some embodiments, the optical writing device 2 may be constituted of a laser optical system using a semiconductor laser as a light source.

Below the intermediate transfer belt 21 are disposed a feed tray 31, a feed roller 41, and paired registration rollers 42. The feed tray 31 stores sheets P serving as sheet-type recording materials. A secondary transfer roller 25 serving as a transfer unit to transfer a toner image from the intermediate transfer belt 21 onto a sheet P is disposed opposing the third tension roller 24 via the intermediate transfer belt 21. A belt cleaning device 27 to clean an outer surface of the intermediate transfer belt 21 is disposed to contact the outer surface of the intermediate transfer belt 21 at a position at which a cleaning opposed roller 26 contacting an inner surface of the intermediate transfer belt 21 contacts the intermediate transfer belt 21. In FIG. 1, at the right side of the registration rollers 42 are disposed a bypass feed path 35, a bypass feed roller 43, and a bypass tray 34 which are used for bypass feed operation.

A sheet transport path 32 extends from the feed tray 31 to an output tray 33. At a downstream side from the secondary transfer roller 25 in a sheet transport direction in the sheet transport path 32 (hereinafter referred to as simply "downstream side) is disposed a fixing device 15 including a heating roller and a pressure roller. The pressing roller of the fixing device 15 includes a heater, which is a heating member, acts as a heat source to fix an image on the sheet P by heat. On the downstream side from the fixing device 15 in the sheet transport path 32 is disposed a cooling conveyor 100 to cool the sheet P. At an exterior of the apparatus body 200 on the downstream side further from the cooling conveyor 100 is disposed the output tray 33 serving as an output unit of the sheet P after toner fixing. The image forming apparatus 300 also includes a reverse transport path 36 for duplex (dual-face) image formation. When an image is formed on a back face of a sheet P in duplex image formation, the sheet P having passed the cooling conveyor 100 is turned around and transported again to the registration rollers 42 via the reverse transport path 36.

An image formation process in the image forming apparatus 300 is described below, taking an example of one image station 10. According to a general electrostatic recording method, in the darkness, the optical writing device 2 irradiates light onto the photoconductor 1 uniformly charged by the charging device 5 to form an electrostatic latent image on the photoconductor 1. The development device 3 supplies toner to the electrostatic latent image on the photoconductor 1 to form a toner image as a visible image. The primary transfer roller 11 transfers the toner image from the photoconductor 1 to the intermediate transfer belt 21. After the transfer, the photoconductor cleaning device 4 cleans an outer surface of the photoconductor 1. Such an image formation process is performed in each of the imaging stations 10Y, 10C, 10M, and 10Bk.

The development devices 3Y, 3C, 3M, and 3Bk in the imaging stations 10Y, 10C, 10M, and 10Bk have visible-image forming functions with the respective color toners. Accordingly, yellow, cyan, magenta, and black are allocated to the imaging stations 10Y, 10C, 10M, and 10Bk, thus allowing formation of a full-color composite image. Each imaging station 10 includes the primary transfer roller 11 disposed opposing the corresponding photoconductor 1 so as to sandwich the intermediate transfer belt 21 between the primary transfer roller 11 and the photoconductor 1. The primary transfer roller 11 is supplied with a transfer bias to form a primary transfer unit.

For the above-described configuration, a common image formation area of the intermediate transfer belt 21 passes the imaging stations 10Y, 10C, 10M, and 10Bk in turn. When the common image formation area passes the imaging stations 10Y, 10C, 10M, and 10Bk in turn, respective single-color toner images are transferred to the intermediate transfer belt 21 by the transfer biases supplied to the primary transfer rollers 11 so that the single-color toner images are superimposed one on another on the intermediate transfer belt 21. Thus, when the above-described common image formation area passes the primary transfer unit of each of the imaging stations 10Y, 10C, 10M, and 10Bk once, a full-color toner image is formed on the common image formation area by the superimposing transfer.

The full-color toner image formed on the intermediate transfer belt 21 is secondarily transferred onto a sheet P fed from the feed tray 31 or the bypass tray 34. After the secondary transfer, the belt cleaning device 27 cleans the intermediate transfer belt 21. Here, the transfer of the full-color toner image from the intermediate transfer belt 21 to the sheet P is performed as follow. For the secondary transfer, a transfer bias is supplied to the secondary transfer roller 25 to form a transfer electric field between the secondary transfer roller 25 and the third tension roller 24 via the intermediate transfer belt 21. The secondary transfer is performed by passing the sheet P through a transfer nipping portion between the secondary transfer roller 25 and the intermediate transfer belt 21. The registration rollers 42 are disposed upstream from the transfer nipping portion in the sheet transport direction. The sheet P fed from the feed tray 31 or the bypass tray 34 is fed by the registration rollers 42 into the transfer nipping portion so as to synchronize the full-color toner image on the intermediate transfer belt 21 conveyed to the transfer nipping portion.

After the secondary transfer of the full-color toner image from the intermediate transfer belt 21 to the sheet P, the fixing device 15 applies heat and pressure to the full-color toner image on the sheet P to fix the full-color toner image on the sheet P (hereinafter referred to as fixing by heat), thus forming the final full-color image on the sheet P. Then, the sheet P is cooled from a single face side or both face sides thereof by the cooling conveyor 100 and stacked onto the output tray 33. The cooling conveyor 100 includes belt conveyance units to sandwich and convey the sheet P and cooling members disposed at an inner circumferential surface side of a conveyance belt of each of the belt conveyance unit. When the sheet P is stacked on the output tray 33, such a configuration can reliably harden toner on the sheet P, thus preventing blocking phenomenon.

Next, examples of control of the cooling conveyor 100 included in the image forming apparatus 300 according to this embodiment are described below.

Here, in the control of the cooling conveyor 100 in each of the examples described below, the temperatures of the cooling member and the conveyance belt of the cooling conveyor 100 are maintained at a certain temperature or lower from when printing is started to when a sheet P contacts the conveyance belt of the cooling conveyor 100. In the following description, the term "front side" of a sheet P represents a side of the sheet P on which toner adheres in a softened state after heating and pressing by the fixing device 15, and the term "back side" represents a side of the sheet P opposite the side on which softened toner adheres. In addition, regarding a direction of each component of the cooling conveyor 100, the term "sheet transport direction" is referred to as a direction parallel to a transport direction of the sheet P which the cooling member cools via the conveyance belt by absorbing heat.

(Embodiment 1)

Next, a cooling conveyor 100 according to an embodiment (Embodiment 1) of this disclosure is described with reference to drawings.

Figure 2:
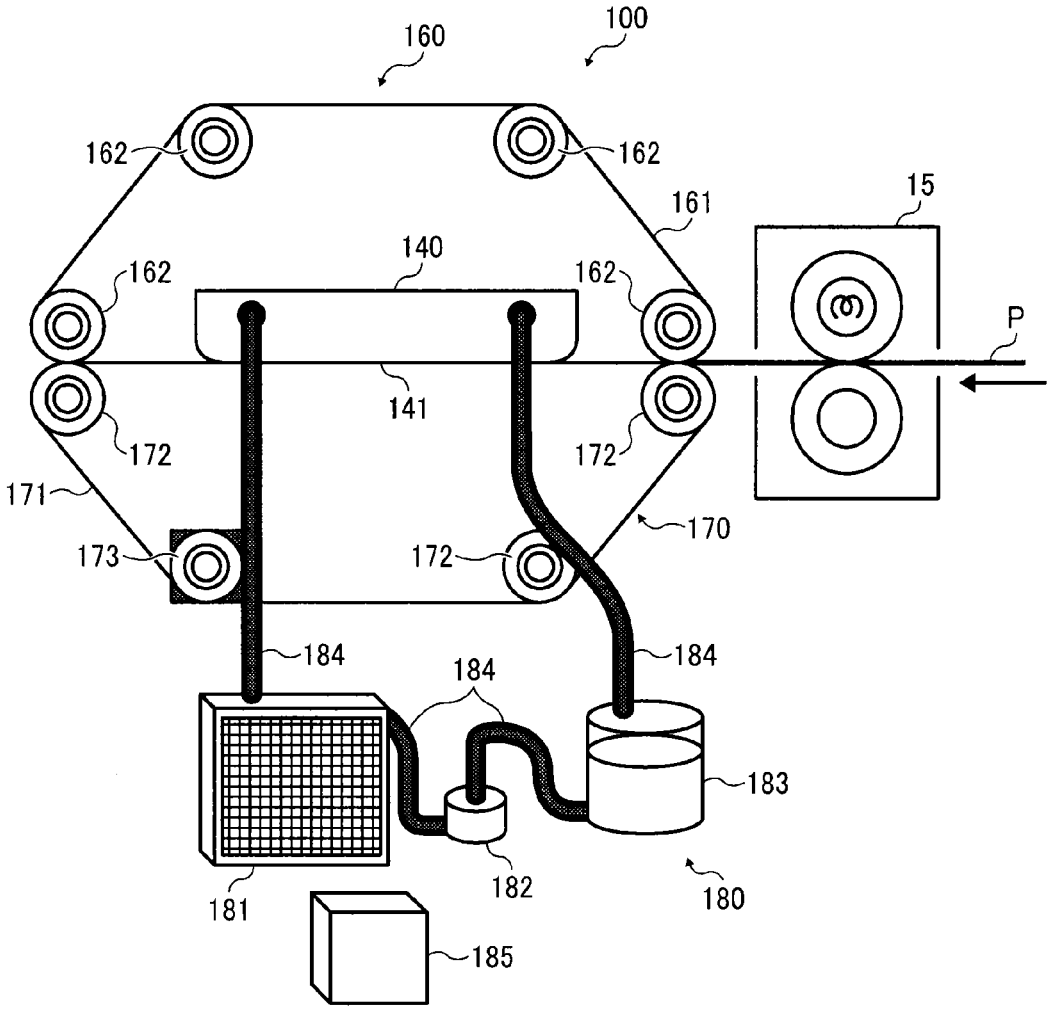
FIG. 2 is a schematic view of a cooling conveyor according to an embodiment (Embodiment 1) of this disclosure.
Figure 3:
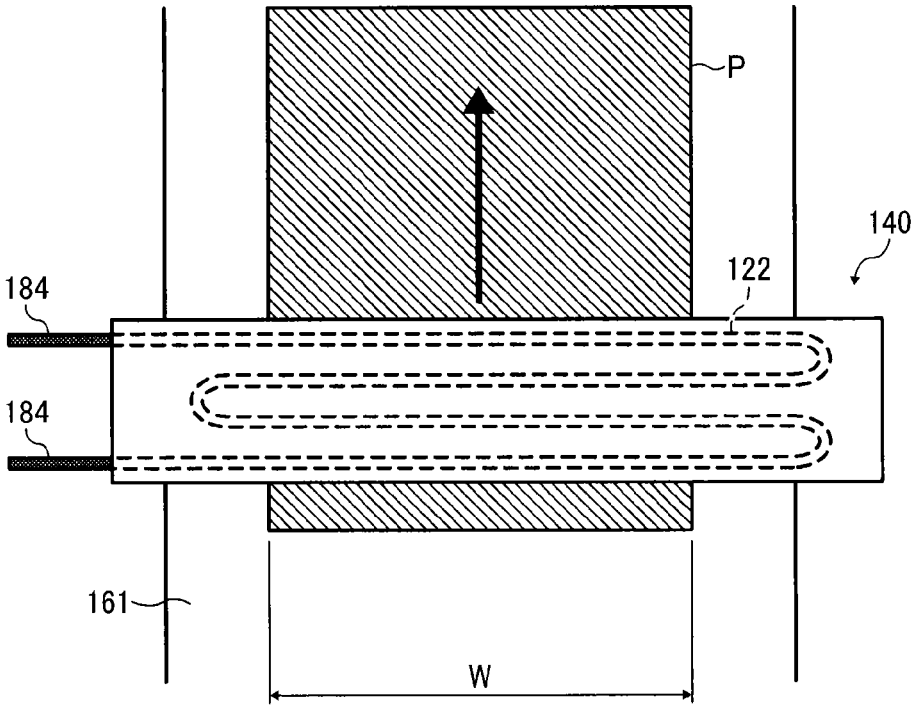
FIG. 3 is a schematic view of a cooling member of the cooling conveyor of FIG. 2.
Figure 4:
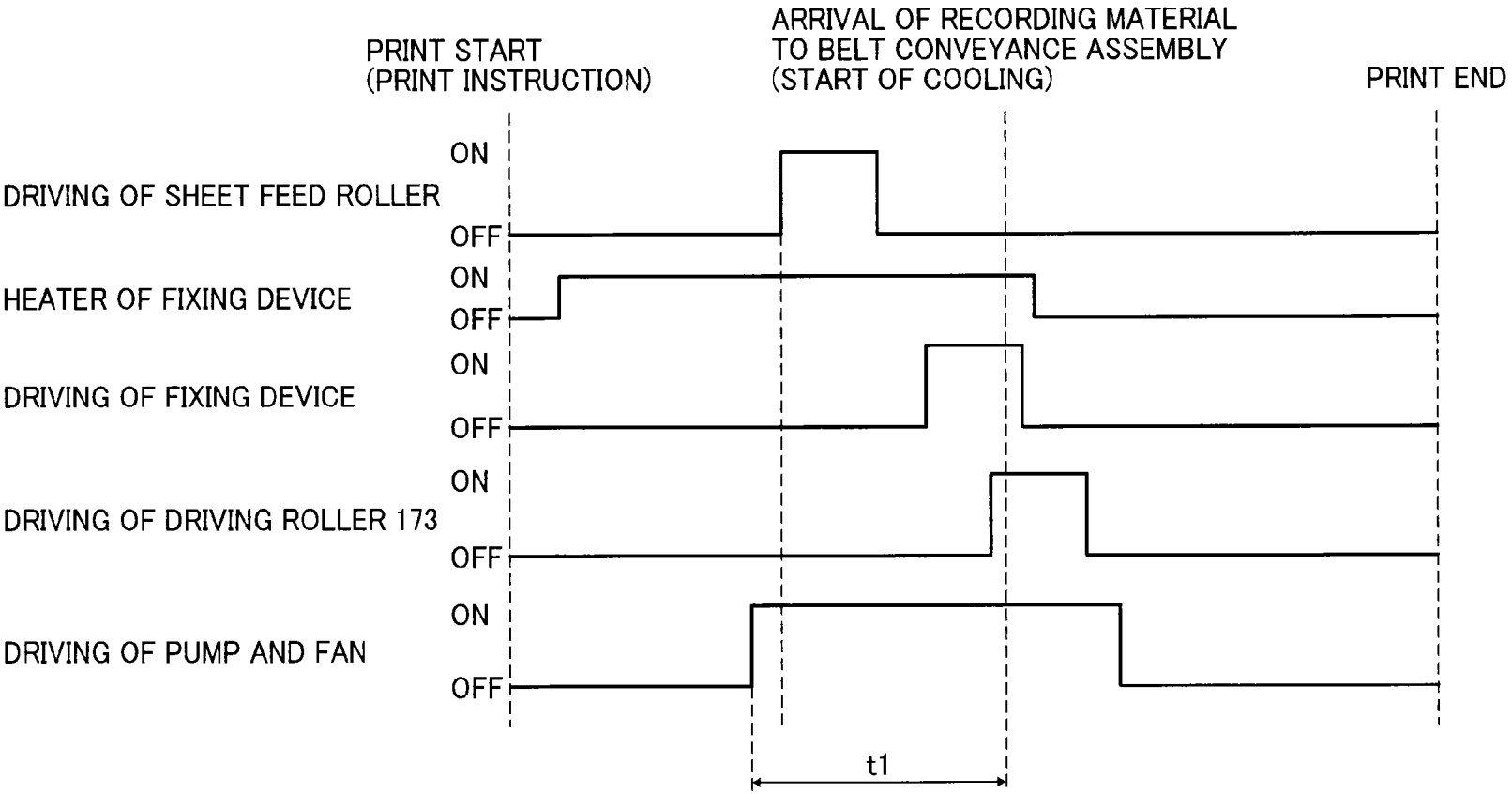
FIG. 4 is a timing chart of preliminary cooling operation of the cooling conveyor according to Embodiment 1.
Figure 5A:
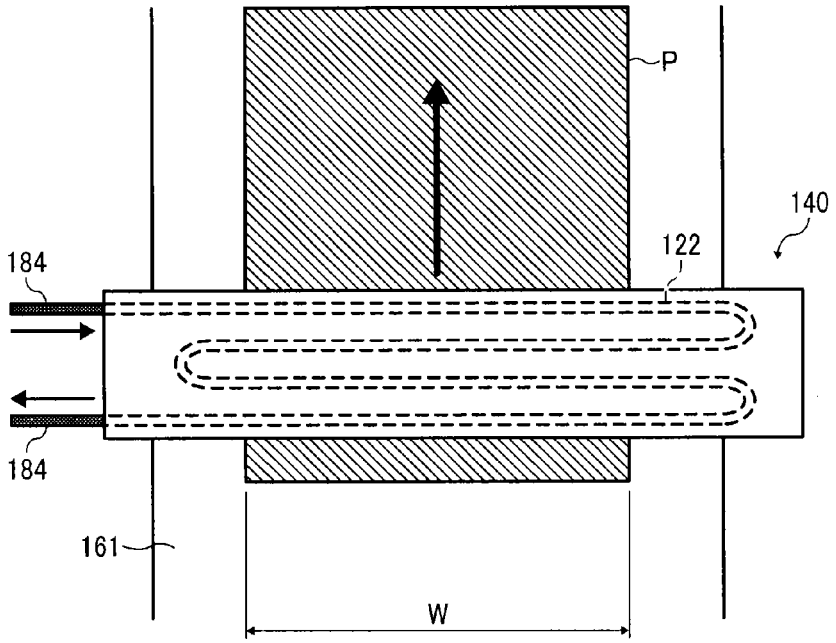
FIGS. 5A and 5B are schematic views of a portion to which a target temperature is set in the cooling conveyor according to Embodiment 1.
Figure 5B:
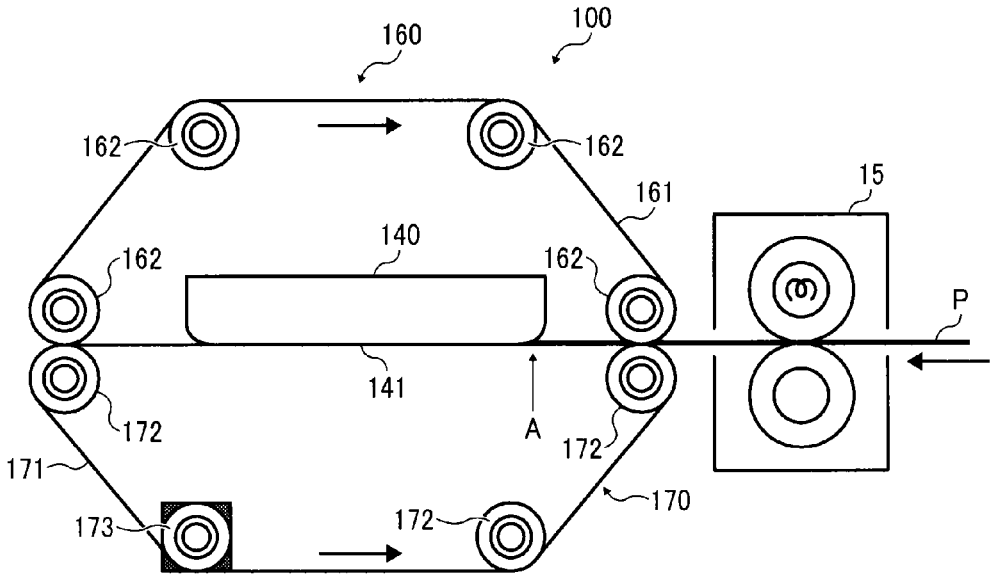

FIG. 2 is a schematic configuration of the cooling conveyor 100 according to this embodiment. FIG. 3 is a schematic view of a cooling member 140 of the cooling conveyor 100 of FIG. 2. FIG. 4 is a timing chart of preliminary cooling operation of the cooling conveyor 100 according to this embodiment. FIGS. 5A and 5B illustrate a portion to which a target temperature is set with the cooling conveyor 100 according to this embodiment. FIG. 5A is a schematic view of arrangement of the cooling member 140 and inflow and outflow directions of cooling liquid flowing through a flow channel 122 of the cooling member 140. FIG. 5B is a cross sectional view of the portion to which a target temperature is set with the cooling conveyor 100.

As illustrated in FIG. 2, the cooling conveyor 100 according to this embodiment has a front-side sandwiching part 160 and a back-side sandwiching part 170 as sandwiching parts to sandwich and convey a sheet P after the fixing device 15 fixes an image on the sheet P. The front-side sandwiching part 160 sandwiches the sheet P from the front side of the sheet P on which toner adheres in a softened state. The back-side sandwiching part 170 sandwiches the sheet P from the back side of the sheet P. The cooling conveyor 100 also has a liquid-cooling-type of external radiator 180 as a cooling device to absorb heat from the sheet P. The cooling member 140 is made of metal (e.g., aluminum) disposed in the front-side sandwiching part 160 and radiates absorbed heat to ambient atmosphere.

The front-side sandwiching part 160 includes, e.g., four front-side follow rollers 162, a front-side conveyance belt 161, and the cooling member 140. The front-side follow rollers 162 are arranged so as to form a trapezoid shape above the sheet transport path 32 in FIG. 2. The front-side conveyance belt 161 is stretched over the four front-side follow rollers 162. The back-side sandwiching part 170 includes, e.g., three back-side follow rollers 172, a driving roller 173, and a back-side conveyance belt 171. The back-side follow rollers 172 are arranged so as to form a trapezoid shape below the sheet transport path 32 in FIG. 2. The back-side conveyance belt 171 is stretched over the back-side follow rollers 172 and the driving roller 173. The back-side follow rollers 172 are connected via a drive transmission unit, such as a gear train, to a driving motor serving as a driving source exclusively used or shared with another driving system. The driving motor serves as a conveyance driving unit (see FIG. 13B and FIG. 14B) controlled for driving by a controller of the apparatus body.

The external radiator 180 includes, e.g., a radiator 181 serving as a heat radiation member, a liquid feed pump 182 serving as a liquid feed unit to feed cooling liquid, a liquid storage tank 183 to store the cooling liquid, and rubber tubes 184. The rubber tubes 184 connect an outlet of an upstream component and an inlet of a downstream component in a feed direction of the cooling liquid and functions as an external flow channel to flow the cooling liquid. In other words, the rubber tube 184*s* connect each of the above-described components/members and the cooling member 110 to form a circulation channel of the cooling liquid. The cooling liquid circulating through the circulation channel serves as a heat transmitter to absorb heat of the sheet P with the cooling member 140 via the front-side endless belt 161 and transmit the absorbed heat to the radiator 181. In this embodiment, the external radiator 180 also has a blowing fan 185 serving as a blower to blow an outside air to the radiator 181 to enhance the heat radiation effect, i.e., the cooling effect of the sheet P.

As illustrated in FIG. 3, the cooling member 140 according to this embodiment is arranged to entirely cover the front-side conveyance belt 161 (back-side conveyance belt 171) in a width direction of the sheet P (hereinafter, sheet width direction). The flow channel 122 has two folded portions on the right side and one folded portion on the left side of FIG. 3 at which linear portions thereof substantially parallel to the sheet width direction are folded. An inlet and an outlet of the flow channel 122 are formed at an upstream side and a downstream side thereof in the sheet transport direction and at a lateral end thereof on the left side in FIG. 3, and the rubber tubes 184 of the external radiator 180 are connected to the inlet and the outlet of the flow channel 122. It is to be noted that the folded portions of the flow channel 122 are disposed outside an area over which a sheet P having a maximum sheet width W is conveyed, to obtain good cooling effect even when the sheet P having the maximum sheet width W to be passed through the image forming apparatus 300 according to this embodiment is conveyed. In particular, the two folded portions on the right side in FIG. 3, at which the inlet and the outlet are not provided, are outside a lateral end of the front-side conveyance belt 161 on the right side in FIG. 3.

For the cooling conveyor 100 thus configured, the back-side follow rollers 172 are driven to rotate counterclockwise in FIG. 2 to endlessly move the back-side conveyance belt 171 counterclockwise. The back-side conveyance belt 171 contacts the front-side conveyance belt 161 directly or indirectly via the sheet P. Thus, the endless movement of the back-side conveyance belt 171 causes the front-side conveyance belt 161 to endlessly move clockwise in FIG. 2. By sandwiching the sheet P with the front-side conveyance belt 161 and the back-side conveyance belt 171 (hereinafter, respective conveyance belts) endlessly moving as described above, the sheet P having an image fixed thereon by heat can be conveyed in a sandwiched state along the sheet transport path 32.

The liquid feed pump 182 is driven to circulate the cooling liquid between the flow channel 122 (see FIG. 3) of the cooling member 140 and the radiator 181. Thus, a cooling surface 141 of the cooling member 140 to indirectly contact the sheet P via the front-side conveyance belt 161 can absorb heat from the sheet P to cool the sheet P. For example, as described above, the cooling member 140 includes the flow channel 122 serving as an internal channel through which the cooling liquid passes. The cooling surface 141 of the cooling member 140 contacts the front-side conveyance belt 161 to absorb heat (a quantity of heat) from the sheet P, and the cooling liquid transports the heat to the outside of the cooling member 140. Thus, the cooling member 140 is maintained at relatively low temperature. In this embodiment, the cooling liquid is stored in the liquid storage tank 183 and is fed by the liquid feed pump 182. When the cooling liquid passes through an internal channel of the radiator 181, heat of the cooling liquid is radiated to the outside air, thus decreasing the temperature of the cooling liquid.

When the cooling liquid thus cooled to low temperature passes though the flow channel 122 in the cooling member 140, the cooling liquid absorbs heat from the cooling member 140 by heat transmission. The cooling liquid thus heated to high temperature returns to the liquid storage tank 183. During driving of the liquid feed pump 182, the cooling liquid circulates between the flow channel 122 of the cooling member 140 and the radiator 181. Thus, heat radiation of the cooling liquid in passing through the internal channel of the radiator 181 and heat absorption of the cooling liquid in passing through the flow channel 122 in the cooling member 140 are repeated. By cooling the sheet P as described above, the temperature of toner heated and softened in the fixing device 15 decreases, thus reliably hardening toner on the sheet P. Thus, when sheets P having toner images are discharged and stacked on the output tray 33 illustrated in FIG. 1, such a configuration can suppress occurrence of blocking phenomenon.

Recently, with increased demand for energy saving, as described above, there has been an increased number of image forming apparatuses capable of shifting to a standby state in which, when printing operation is finished and no print instruction is received, a controller performs control of reducing or stopping power supply to devices other than, e.g., a controller. The image forming apparatus 300 according to this embodiment also shifts to a standby state as described above. When the image forming apparatus 300 shifts to the standby state, in the cooling conveyor 100, driving of the driving roller 173 stops. The liquid feed pump 182 and the blowing fan 185 of the external radiator 180 to maintain the cooling member 140 at low temperature also stop, thus stopping circulation of the cooling liquid flowing through the flow channel 122 in the cooling member 140. At this time, in the fixing device 15, driving of a fixing roller stops and the heater is turned off. However, residual heat remains in the fixing device 15. As a result, the cooling member 140 and the front-side conveyance belt 161 of the cooling conveyor 100 disposed near the fixing device 15 constantly receive heat from the fixing device 15.

In particular, since the driving roller 173 is stopped and the external radiator 180 is stopped, the cooling member 140 or the front-side conveyance belt 161 may be heated to high temperature if standby time is long. As a result, the following failure might occur depending on control of the cooling conveyor 100 performed when the image forming apparatus 300 receives an image formation signal and shifts from the standby state to image forming operation (hereinafter, start of printing), that is, starts printing from the standby state. For example, if the driving roller 173 is activated when a sheet P arrives at the respective conveyance belts of the cooling conveyor 100 after start of printing and the external radiator 180 is activated simultaneously with activation of the driving roller 173, the sheet P having an image fixed by heat might not be sufficiently cooled. For an image forming apparatus having a typical cooling conveyor, such a failure may also occur since the cooling conveyor is disposed near a fixing device on a downstream side in a sheet transport direction and the sheet is cooled immediately after fixing by heat.

For such arrangement, the respective conveyance belts and the cooling member 140 may be heated to high temperature by heat of the fixing device 15 in a standby state in which the image forming apparatus 300 waits for receipt of an image formation signal or a standby state immediately after the image forming apparatus 300 is once powered off and powered on again before a predetermined time or more passes from the previous image forming operation. In such a case, a small temperature difference arises between the sheet P after fixing by heat and each of the cooling member 140 absorbing heat of the sheet P via each conveyance belt and the front-side conveyance belt 161 which the sheet P contacts. Such a small temperature difference reduces the amount of heat transferred from the sheet P to the front-side conveyance belt 161. As a result, cooling efficiency may decrease and desired cooling performance may not be obtained, thus causing the above-described failure. For the circulation of the cooling liquid, likewise, if the liquid feed pump 182 is activated with activation of the driving roller 173 to start circulation of the cooling liquid, cooling efficiency would decrease in an initial period of printing operation. Hence, as described below, the image forming apparatus 300 performs control in which, at a start of printing from the standby state, the cooling unit is activated ahead of the contact of a sheet P with the cooling conveyor 100 and then the sheet P is brought into contact with the respective conveyance belts.

Next, operation timing of related devices in printing is described with reference to FIG. 4.

In a timing chart illustrated in FIG. 4, solid lines represent control signals and ON represents rising of signal. When a print instruction is received and printing is started from the standby state, the heater of the fixing device 15 is turned on. Driving of the feed roller 41 is started to feed a sheet P, and driving of the fixing roller of the fixing device 15 is started. Driving of the driving roller 173 is started immediately before the sheet P enters the cooling conveyor 100 (contacts the respective conveyance belts).

After the heater of the fixing device 15 is turned ON, driving of the liquid feed pump 182 and the blowing fan 185 is turned ON to start circulation of the cooling liquid through the flow channel 122 of the cooling member 140. The cooling liquid stopped in the flow channel 122 during standby moves out from the flow channel 122 and is cooled by the radiator 181. The cooling liquid thus cooled at an upstream side of the flow channel 122 flows into the flow channel 122, and as a result, the cooling member 140 is cooled via the flow channel 122. While a time t1 passes after a start of driving of the cooling unit at which driving of the liquid feed pump 182 and the blowing fan 185 is started, the temperature of the cooling member 140 falls to a target temperature or lower and the sheet P arrives at a contact position at which the sheet P contacts the respective conveyance belts.

The above-described time t1 is a driving time of the liquid feed pump 182 and the blowing fan 185 required to decrease the temperature of the cooling member 140 to the target temperature. During the driving time, the liquid feed pump 182 and the blowing fan 185 are driven before the sheet P contacts the respective conveyance belts. It is to be noted that, for the cooling conveyor 100 according to this embodiment, as illustrated in FIG. 5A, the cooling liquid flows into the flow channel 122 from the most downstream side in the sheet transport direction and is flown out (discharged) from the most upstream side in the sheet transport direction.

Accordingly, as illustrated in FIG. 5B, when a leading end of the sheet P arrives at a most upstream end (indicated by arrow A in FIG. 5B and hereinafter referred to as position A), the cooling surface 141 is at the target temperature, thus resulting in a large difference between the surface temperature of the sheet P and the front-side conveyance belt 161. As a result, since the transfer amount of heat from the sheet P to the front-side conveyance belt 161 is large, such a configuration can obtain higher cooling efficiency than a configuration in which this embodiment is not applied. In other words, in absorbing heat from the sheet P via the front-side conveyance belt 161 by the cooling member 140, the above-described configuration can more effectively decrease the temperature of the respective conveyance belts contacting the cooling surface 141 at the most upstream end of the cooling member 140 in the sheet transport direction, than a different configuration. Such a configuration can reduce the time required for preliminary cooling operation of the cooling conveyor 100 in starting printing from the standby state, and can enhance cooling performance of the cooling conveyor 100 in continuously cooling sheets P. Here, when the cooling member 140 is cooled, the respective conveyance belts are stopped. Accordingly, a portion of the belt surface which does not contact the cooling surface 141 of the cooling member 140 at an upstream side from the cooling member 140 in a moving direction of the front-side conveyance belt 161 remains warm.

However, when the driving roller 173 starts to be driven and the front-side conveyance belt 161 contacts the cooling surface 141, heat of the contact portion of the belt surface is absorbed by the cooling surface 141. As a result, when the leading end of the sheet P arrives at the upstream end of the cooling surface 141 in the sheet transport direction, the above-described configuration can obtain a greatly decreased belt surface temperature as compared to a configuration to which this embodiment is not applied. For example, in a configuration in which this embodiment is not applied, the belt temperature in the vicinity of the position A is 75 degrees C. In the configuration in which this embodiment is applied, the belt temperature in the vicinity of the position A is 50 degrees C. Since the surface temperature of the sheet P entering the cooling conveyor 100 is 75 degrees C., simply, the cooling effect is five times. Accordingly, when the leading end of the sheet P contacts the upstream end of the cooling surface, the cooling surface can absorb heat of the sheet P via the belt.

As described above, by decreasing the temperature of the cooling member 140 before the sheet P arrives at the cooling member 140, such a configuration can also efficiently cool a sheet P first conveyed after a return (print start) from the standby state. In addition, in absorbing heat from the sheet P via the front-side conveyance belt 161 by the cooling member 140, the above-described configuration can more effectively decrease the temperature of the front-side conveyance belt 161 contacting the cooling surface 141 at the most upstream end of the cooling member 140 in the sheet transport direction, than a different configuration. Accordingly, such a configuration can reduce the time required for preliminary cooling operation of the cooling conveyor 100 in starting printing from the standby state, and can enhance cooling performance of the cooling conveyor 100 in continuously cooling sheets P.

In addition, since the time t1 is a period later than a start timing of warm up of the fixing device, the above-described configuration also can efficiently cool a first sheet conveyed after a return from standby while maintaining the first print time after standby at the same length as a conventional art. In other words, since the time t1 is set in the warm-up time, the above-described configuration can also efficiently cool a first sheet conveyed after a return from standby while maintaining the first print time after standby at the same length as a conventional art. In addition, for the above-described example, the temperature of the cooling member 140 is cooled to the target temperature. Actually, since the flow channel 122 is arranged so as to be folded in the cooling member 140, there is a temperature difference between the upstream end and a downstream end of the cooling member 140 in the sheet transport direction. Hence, in this embodiment, the target temperature is set as the temperature of the upstream end of the cooling member 140 in the sheet transport direction at the position A illustrated in FIG. 5B.

As described above, the cooling conveyor 100 according to this embodiment employs the liquid-cooling-type external radiator 180 as a cooling unit to maintain the cooling member 140 at low temperatures. Such a configuration can more efficiently decrease the temperature of the cooling member 140 absorbing heat of the sheet P via the front-side conveyance belt 161 than a cooling conveyor employing an air-cooling-type radiator. Accordingly, such a configuration can reduce the time required for preliminary cooling operation and more effectively suppress a reduction in cooling performance of the cooling conveyor 100 when printing is started from the standby state, than a cooling conveyor employing an air-cooling-type radiator. In addition, such a configuration can finish preliminary cooling operation during warm-up of the heater of the fixing device 15. Accordingly, such a configuration can sufficiently cool a sheet P first fixed by heat after a start of printing from the standby state, without reducing the productivity of the image forming apparatus 300.

As illustrated in FIG. 2, the outlet of the internal channel of the radiator 181 is directly connected to the inlet of the flow channel 122 of the cooling member 140 via the rubber tube 184. Such a configuration allows the cooling liquid to be supplied to the flow channel 122 of the cooling member 140 immediately after the cooling liquid is cooled by the radiator 181, thus shortening the time required for decreasing the temperature of the cooling member 140 to a desired temperature. Accordingly, when printing is started from the standby state, such a configuration can more reduce the time required for preliminary cooling operation than a configuration in which a component member according to another liquid-cooling-type is disposed between the radiator 181 and the cooling member 140.

A time t of preliminary cooling operation started before the sheet P contacts the respective conveyance belts is a driving time of the external radiator 180 that is required to decrease the temperature of the cooling member 140 to a predetermined target temperature. For such a configuration, by the preliminary cooling operation performed before the sheet P contacts the respective conveyance belts, the temperature of the cooling member 140 is preliminarily decreased to a predetermined target temperature, at which the cooling member 140 can sufficiently cool the sheet P. Thus, when printing is started from the standby state, a reduction in cooling performance of the cooling conveyor 100 can be reliably suppressed. In this embodiment, as illustrated in the timing chart of FIG. 4, driving of the feed roller 41 is described as an example of driving of a sheet conveyance device relating to a timing when the sheet P contacts the respective conveyance belts of the cooling conveyor 100. Alternatively, in another example, driving of the registration rollers 42 may be used.

(Embodiment 2)

Next, a cooling conveyor 100 according to an embodiment (Embodiment 2) of this disclosure is described with reference to FIGS. 6A and 6B and FIG. 7.

Figure 6A:
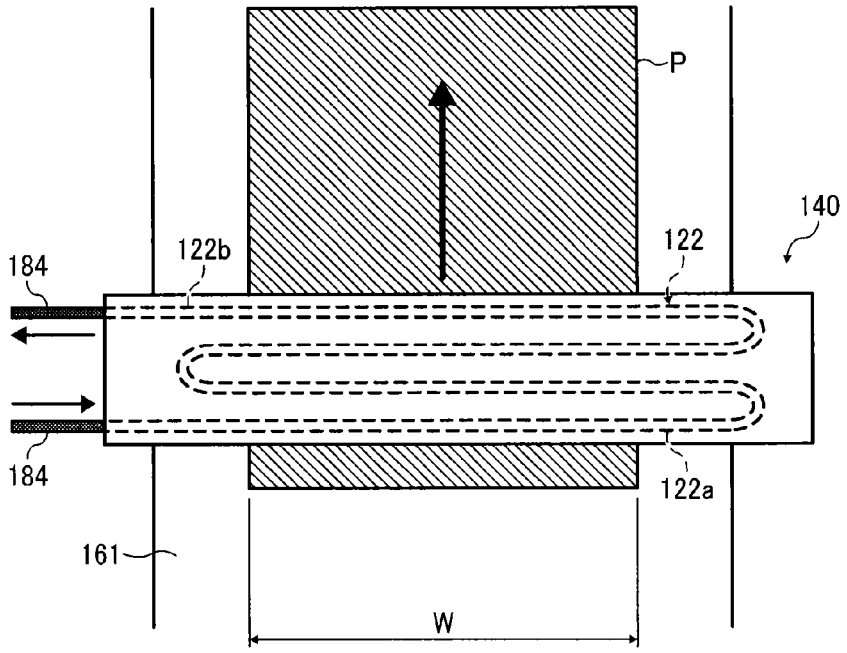
FIGS. 6A and 6B are schematic views of a portion to which a target temperature is set in a cooling conveyor according to an embodiment (Embodiment 2) of this disclosure.
Figure 6B:
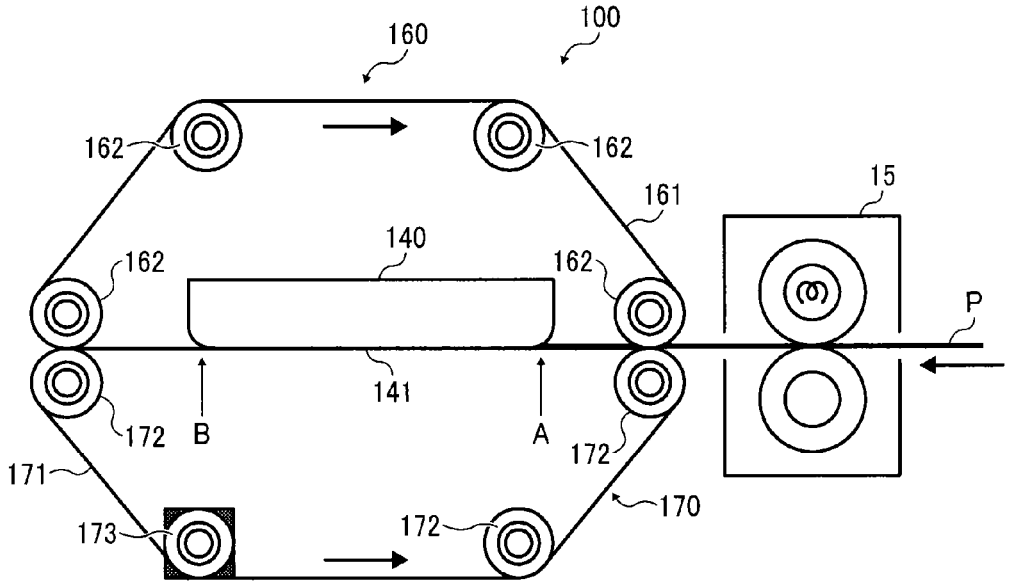
Figure 7:
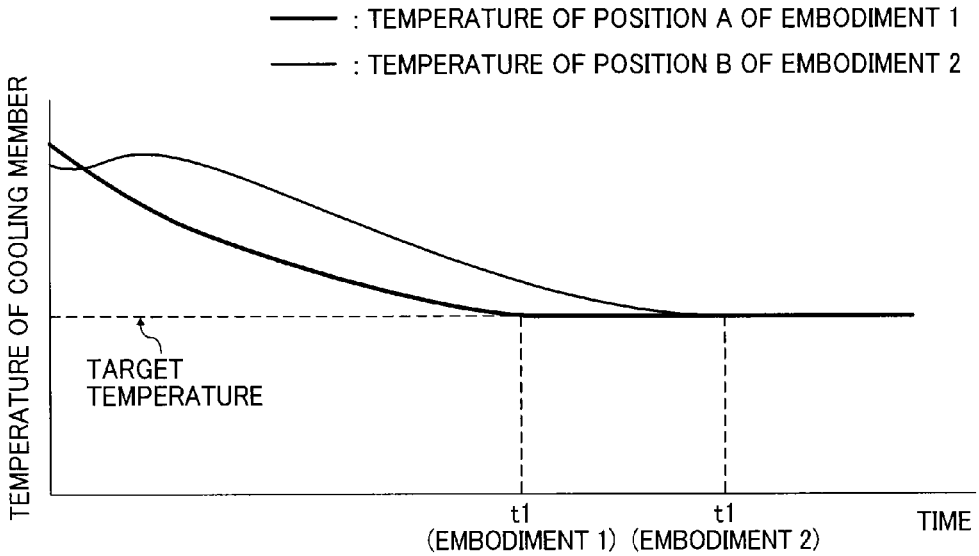
FIG. 7 is a chart of a relation between time from a return to image forming operation and temperature of a cooling member in Embodiment 2.

FIGS. 6A and 6B illustrate a portion to which a target temperature is set in the cooling conveyor 100 according to this embodiment. FIG. 7 is a chart of a relation between time from a return and the temperature of the cooling member 140 in this embodiment. This embodiment differs from the above-described Embodiment 1 only in a direction in which the cooling liquid flows through the flow channel 122 of the cooling member 140. Therefore, configurations, actions, operations, and effects similar to those of the above-described Embodiment 1 are omitted below for simplicity.

Specifically, the cooling conveyor 100 according to this embodiment differs from the above-described Embodiment 1 in that, as illustrated in FIG. 6A, cooling liquid flows into a flow channel 122 from the most upstream side in the sheet transport direction and is flown out (discharged) from the most downstream side in the sheet transport direction. For such an inflow direction of cooling liquid, the cooling liquid absorbs heat of the sheet P in a channel portion 122*a* of the flow channel 122 at the most upstream side in the sheet transport direction and flows to a channel portion 122*b* of the flow channel 122 at a most downstream side in the sheet transport direction. As a result, if the temperature of the position A is set to the target temperature like the above-described Embodiment 1, the entire cooling efficiency of the cooling member might decrease. Hence, in this embodiment, a time t1 is set so that the temperature of a position B illustrated in FIG. 6B that is the most downstream end of the cooling member 140 in the sheet transport direction becomes a target temperature.

Here, t1 in this embodiment (Embodiment 2) and t1 in the above-described Embodiment 1 are described with reference to FIG. 7. For the above-described Embodiment 1, warm cooling liquid staying in the channel portion 122*a* most proximal to the fixing device 15 is discharged to a rubber tube 184, and the cooling liquid flowing into the channel portion 122*a* flows from a position farther away from the fixing device 15. Accordingly, the cooling liquid flowing into the channel portion 122*a* has a temperature lower than the cooling liquid staying in the channel portion 122*a*. As a result, as illustrated in a bold line in FIG. 7, since the temperature of the cooling liquid gradually decreases after a start of printing (a return) from the standby state, the temperature of the position A of the cooling member also decreases with the decrease in the temperature of the cooling liquid.

On the other hand, for this embodiment, since the channel portion 122*a* is a channel portion most proximal to the fixing device 15, the cooling liquid heated during standby flows to the channel portion 122*b* disposed at the downstream side. In addition, the temperature of the cooling liquid during standby is proportional to the distance from the fixing device 15, and the channel portion 122*b* has a lower temperature than the channel portion 122*a*. Accordingly, after the start of printing (return), the temperature of the cooling liquid in the channel portion 122*b* immediately rises from the temperature during standby. As a result, the temperature of the position B which is the most downstream end of the cooling member 140 in the sheet transport direction. Then, as the cooling liquid cooled inflows from the channel portion 122*a*, the temperature of the cooling liquid in the channel portion 122*b* gradually falls. As described above, for this embodiment, the temperature of the cooling liquid flowing through the channel portion 122*b* temporarily rises and then falls. As a result, as illustrated in FIG. 7, t1 in this embodiment is longer than t1 in the above-described Embodiment 1.

However, even in t1 of this embodiment, as illustrated in FIG. 4, during a warm-up period of the fixing device 15, the configuration of this embodiment also can efficiently cool a sheet first conveyed after a return from standby while maintaining the first print time after standby at the same length as a conventional art. In addition, in absorbing heat from the sheet P via the front-side conveyance belt 161 by the cooling member 140, the configuration of this embodiment can decrease, to a desired temperature, the temperature of the front-side conveyance belt 161 contacting the cooling surface 141 at the most upstream end of the cooling member 140 in the sheet transport direction. Accordingly, even in the configuration in which the flow channel 122 of the cooling member 140 is formed so as to flow the cooling liquid from the upstream side to the downstream side in the sheet transport direction, this embodiment can sufficiently cool a sheet P first fixed by heat after a start of printing from the standby state.

(Embodiment 3)

Next, a cooling conveyor 100 according to an embodiment (Embodiment 3) of this disclosure is described with reference to FIGS. 8 and 9.

Figure 8:
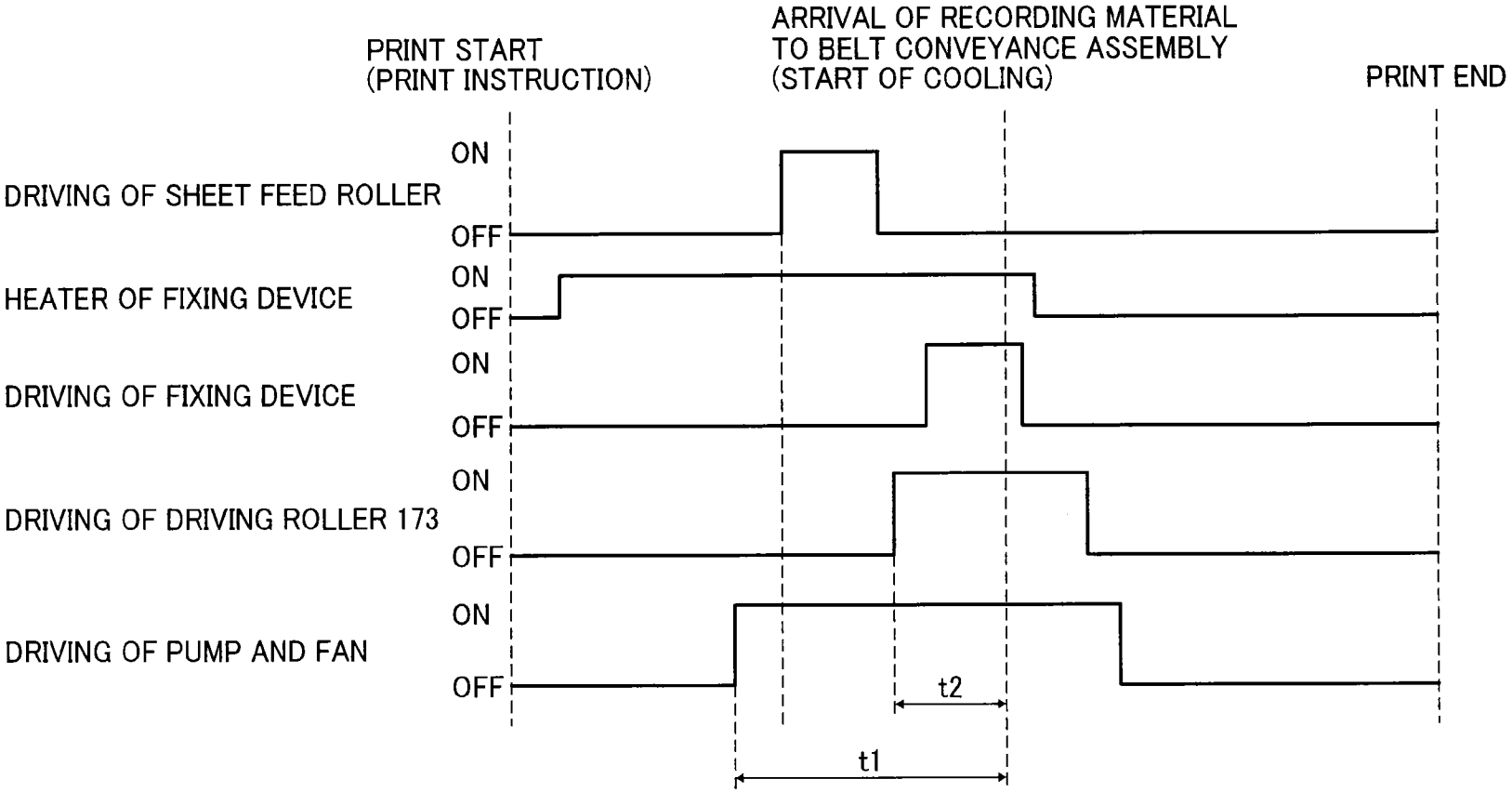
FIG. 8 is a timing chart of preliminary cooling operation of a cooling conveyor according to an embodiment (Embodiment 3) of this disclosure.

FIG. 8 is a timing chart of preliminary cooling operation of the cooling conveyor 100 according to this embodiment. FIG. 9 is a schematic view of preliminary cooling operation of the cooling conveyor 100 according to this embodiment. This embodiment differs from the above-described Embodiment 1 or 2 in that the preliminary cooling operation of the cooling conveyor 100 includes an operation of driving a driving roller 173 (belt conveyance unit) for a predetermined time to preliminarily decrease the temperature of a heated portion of each conveyance belt. Therefore, configurations, actions, operations, and effects similar to those of the above-described Embodiment 1 or 2 are omitted below for simplicity.

In this embodiment, when the heat capacity and temperature of the front-side conveyance belt 161 and the back-side conveyance belt 171 are not negligible, driving of the driving roller 173 is set to be earlier by a certain time in addition to the configuration of the above-described Embodiment 1 or 2. Specifically, a drive start time t2 (hereinafter, time t2) of the conveyance belt of the driving roller 173 is a time during which the driving roller 173 is driven before the sheet P contacts the respective conveyance belts. The time t2 is determined based on a time required to move and bring a non-contact portion of the front-side conveyance belt 161, which does not contact the cooling surface 141 during standby, into contact with the cooling surface 141 by driving of the driving roller 173 before the sheet P contacts the respective conveyance belts. In other words, the time t2 is a time required for circulating the front-side conveyance belt 161 by substantially a round.

The start timing of t1 and the time t1 are the same as those of the above-described Embodiment 1 described with reference to FIG. 4. A start timing of the time t2 is set after a predetermined time has passed since the liquid feed pump 182 and the blowing fan 185 of the external radiator 180 start to be driven. For such a configuration, a portion exposed to high temperature of the front-side conveyance belt 161 and the back-side conveyance belt 171 contacts the cooling surface 141 cooled, before the sheet P thermally fixed and heated to high temperature is conveyed and contacts. As a result, the sheet P thermally fixed contacts a non-high-temperature portion of the front-side conveyance belt 161 and the back-side conveyance belt 171, thus preventing a reduction in cooling performance.

Next, a way of determining t2 is described with reference to FIG. 9. A typical example of the setting of t2 is that, a leading end of a sheet P conveyed contacts a portion of the front-side conveyance belt 161 which contacts the cooling surface 141 for a certain time and decreases in temperature and a portion of the back-side conveyance belt 171 contacting the portion of the front-side conveyance belt 161.

Figure 9:
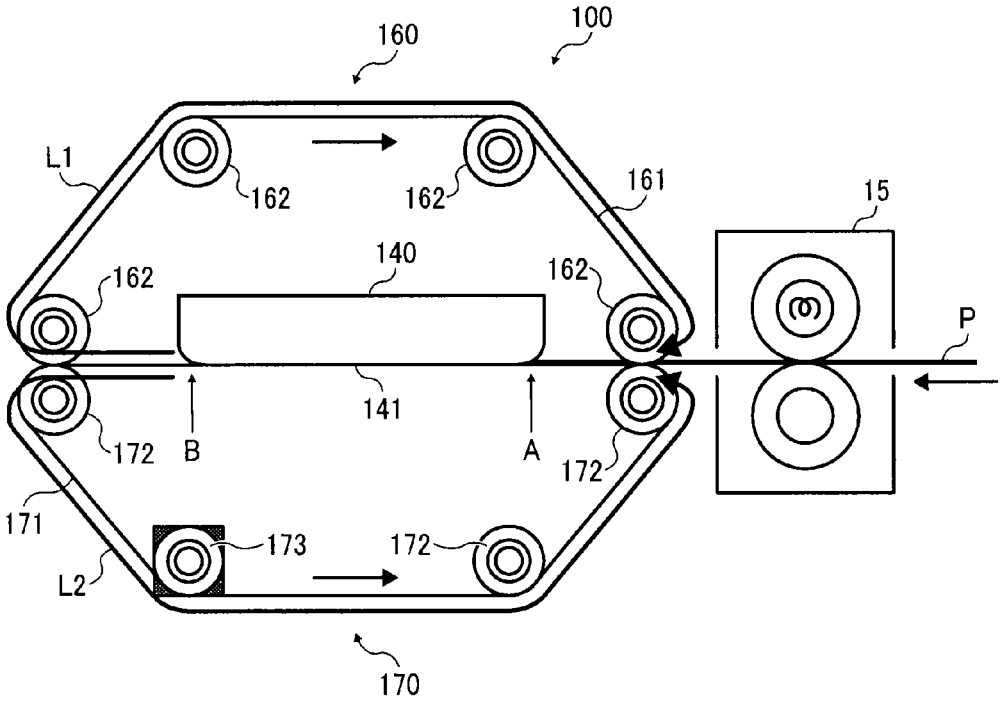
FIG. 9 is a schematic view of preliminary cooling operation of the cooling conveyor according to Embodiment 3.

Here, L1 (indicated by an arrow drawn along the front-side conveyance belt 161 in FIG. 9) represents a distance by which a portion (position B in FIG. 9) of the front-side conveyance belt 161 which contacts the downstream end of the cooling surface 141 in the sheet transport direction is moved to a position joining to a route of the sheet P by driving of the driving roller 173. In addition, L2 (indicated by an arrow drawn along the back-side conveyance belt 171 in FIG. 9) represents a distance by which a portion (position B in FIG. 9) of the back-side conveyance belt 171 which contacts the downstream end of the cooling surface 141 in the sheet transport direction is moved to a position joining to a route of the sheet P by driving of the driving roller 173. Where v represents linear velocity of each conveyance belt, t2 can be determined by the following Equations 1 and 2.

$$L=\max(L1, L2) \quad \text{Equation 1}$$

$$t2=L/v \quad \text{Equation 2}$$

As described above, for the cooling conveyor 100 according to this embodiment, the preliminary cooling operation performed before the sheet P contacts the front-side conveyance belt 161 includes the operation in which driving of the driving roller 173 is started earlier by a certain time to preliminarily decrease the temperature of a portion of each conveyance belt heated to high temperature. Accordingly, by the preliminary cooling operation performed before the sheet P contacts the respective conveyance belts, the temperature of the portion of each conveyance belt heated to high temperature can be preliminarily decreased. Such a configuration can more suppress a reduction in cooling performance of the cooling conveyor 100 when printing is started from the standby state than the configuration of the above-described Embodiment 1 or 2.

In addition, driving of the driving roller 173 is started in the time t1 during which the external radiator 180 is activated to decrease the temperature of the cooling member 140. Thus, driving of the driving roller 173 is started in the time t1 during which the external radiator 180 is activated to decrease the temperature of the cooling member 140, and the respective conveyance belts contact the cooling member 140 which starts to decrease in temperature, thus effectively decreasing the temperature of each conveyance belt.

(Embodiment 4)

Next, a cooling conveyor 100 according to an embodiment (Embodiment 4) of this disclosure is described with reference to FIGS. 10A and 10B.

Figure 10A:
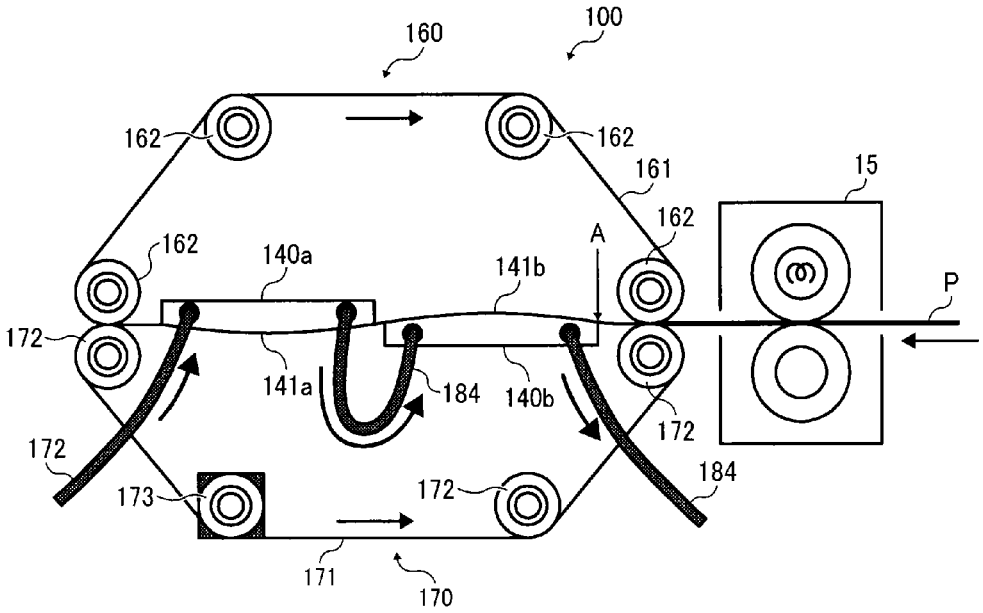
FIGS. 10A and 10B are schematic views of a portion to which a target temperature is set in a cooling conveyor according to an embodiment (Embodiment 4) of this disclosure.
Figure 10B:
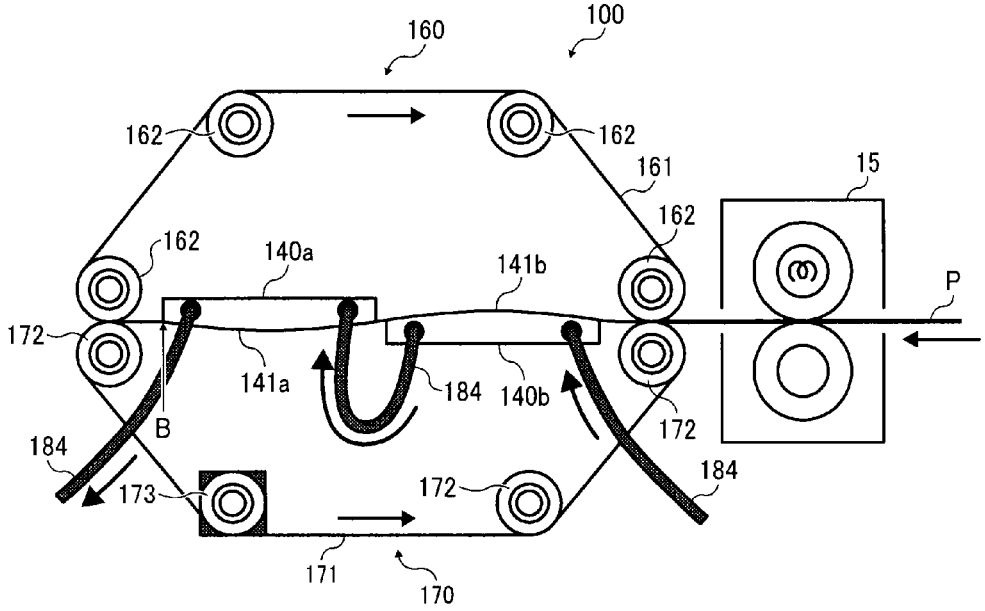

FIGS. 10A and 10B illustrate a portion to which a target temperature is set in the cooling conveyor 100 according to this embodiment. FIG. 10A shows a configuration in which, like the above-described Embodiment 1, cooling liquid flows into a flow channel 122 of each cooling member 140 from a most downstream side of each cooling member 140 in a sheet transport direction. FIG. 10B shows a configuration in which, like the above-described Embodiment 2, cooling liquid flows into a flow channel 122 of each cooling member 140 from a most upstream side of each cooling member 140 in a sheet transport direction. This embodiment differs from the above-described Embodiment 1, 2, or 3 in that cooling members 140*a* and 140*b* are arranged to contact inner circumferential surfaces of a front-side conveyance belt 161 and a back-side conveyance belt 171, respectively. Therefore, configurations, actions, operations, and effects similar to those of the above-described Embodiment 1, 2, or 3 are omitted below for simplicity.

In this embodiment, as described above, the cooling members 140*a* and 140*b* are arranged to contact the inner circumferential surfaces of the front-side conveyance belt 161 and the back-side conveyance belt 171, respectively. The cooling members 140*a* and 140*b* are serially connected to each other via rubber tubes 184. As described above, for the configuration illustrated in FIG. 10A, the cooling liquid flows from the most downstream side of each cooling member 140 in the sheet transport direction into the flow channel 122 of each cooling member 140. By contrast, for the configuration illustrated in FIG. 10B, the cooling liquid flows from the most upstream side of each cooling member 140 in the sheet transport direction into the flow channel 122 of each cooling member 140. Hence, for the configuration illustrated in FIG. 10A, t1 is set so that the temperature of a position A illustrated in FIG. 10A which is an upstream end of the cooling member 140*b* in the sheet transport direction becomes a target temperature. By contrast, for the configuration illustrated in FIG. 10B, t1 is set so that the temperature of a position B illustrated in FIG. 10B which is a downstream end of the cooling member 140*a* in the sheet transport direction becomes a target temperature.

As described above, if the position at which the cooling liquid flows into the flow channel 122 of the cooling member 140 is at the most downstream end of the cooling member 140 in the sheet transport direction, the position of the most upstream end is set to the target temperature. By contrast, if the position at which the cooling liquid flows into the flow channel 122 of the cooling member 140 is at the most upstream end of the cooling member 140 in the sheet transport direction, the position of the most downstream end is set to the target temperature. Therefore, if the number of the cooling members 140 is larger than the above-described configuration, the position A in FIG. 10A or the position B in FIG. 10B is set to the target temperature in accordance with this way, thus obtaining effects equivalent to those of the above-described Embodiment 1, 2, or 3. It is to be noted that, by serially connecting the cooling members 140*a* and 140*b*, the total length of the flow channels 122 in the cooling members 140*a* and 140*b* is increased as compared to that of the above-described Embodiment 1, 2, or 3. As a result, t1 increases by a time corresponding to the increase in the length of the flow channels 122. In such a case, effects equivalent to those of the above-described Embodiment 1, 2, or 3 are obtained by setting t1 in a period during the heater of the fixing device is turned on. In addition, t2 is increased by an increase in the circumferential length of the belt as compared to that of the above-described Embodiment 3. However, effects equivalent to those of the above-described Embodiment 3 are obtained by setting t2 in the time t1.

(Embodiment 5)

Next, a cooling conveyor 100 according to an embodiment (Embodiment 5) of this disclosure is described with reference to FIGS. 11A, 11B, and 12.

Figure 11A:
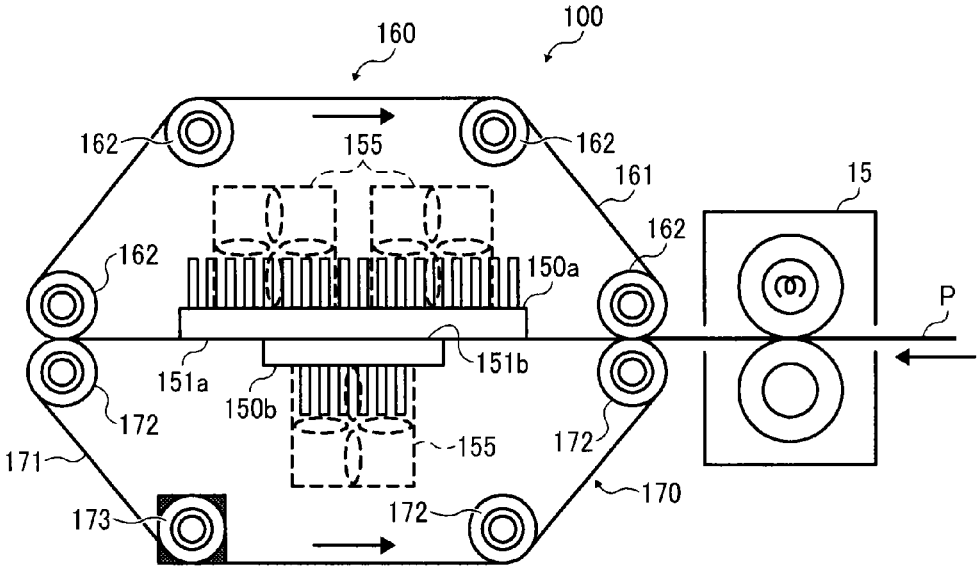
FIGS. 11A and 11B are schematic views of a portion to which a target temperature is set in a cooling conveyor according to an embodiment (Embodiment 5) of this disclosure.
Figure 11B:
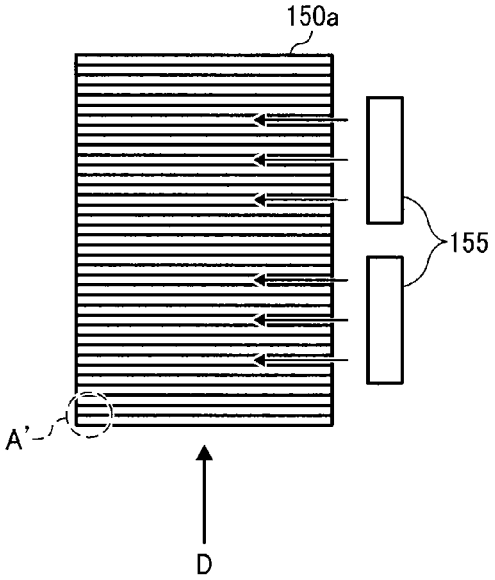
Figure 12:
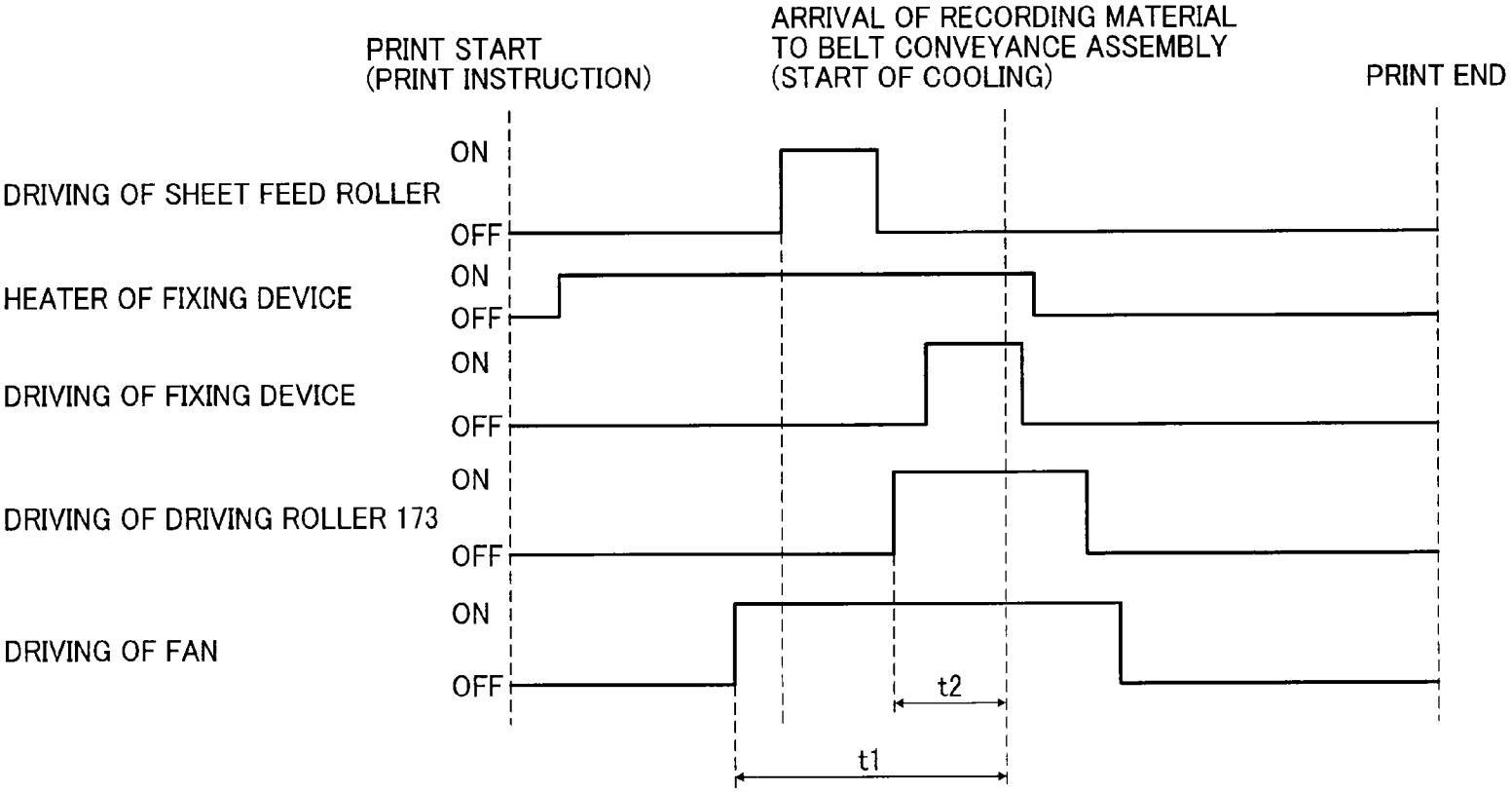
FIG. 12 is a timing chart of preliminary cooling operation of the cooling conveyor according to Embodiment 5.

FIGS. 11A and 11B illustrate a portion to which a target temperature is set in the cooling conveyor 100 according to this embodiment. FIG. 11A is a cross-sectional view of the cooling conveyor 100 according to this embodiment. FIG. 11B is a plan view of the cooling conveyor 100 according to this embodiment. FIG. 12 is a timing chart of preliminary cooling operation of the cooling conveyor 100 according to this embodiment. This embodiment differs from the above-described Embodiment 1, 2, 3, or 4 in that, while the above-described Embodiment 1, 2, 3, or 4 employs a liquid cooling system, this embodiment employs an air cooling system having air-cooling heat sinks 150*a* and 150*b* with a plurality of heat radiation fins serving as cooling members. Therefore, configurations, actions, operations, and effects similar to those of the above-described Embodiment 1, 2, 3, or 4 are omitted below for simplicity.

As illustrated in FIGS. 11A and 11B, unlike the above-described Embodiment 1, 2, or 3 employing a liquid cooling system, the cooling conveyor 100 according to this embodiment has the air-cooling heat sinks 150*a* and 150*b* with a plurality of heat radiation fins serving as cooling members. Cooling surfaces 151*a* and 151*b* of the cooling members 150*a* and 150*b* are arranged to contact the inner circumferential surfaces of a front-side conveyance belt 161 and a back-side conveyance belt 171, respectively. To facilitate heat radiation, a blowing fan 155 is disposed to blow air into between the plurality of radiation fins of the air-cooling heat sinks 150*a* and 150*b*. (In FIG. 11B, a sheet transport direction is indicated by arrow D.) Accordingly, unlike the above-described Embodiment 1, 2, or 3, components used for circulating the cooling liquid, such as the liquid feed pump 182 of the external radiator 180, is not provided.

A fixing device 15 is disposed at a lower side in the plan view of FIG. 11B. Accordingly, since cool wind passes through each radiation fin, a portion close to the blowing fan 155 is cooled. However, the cool wind flows to a downstream side, an area A' indicated by a broken-line circle illustrated in FIG. 11B shows a highest temperature. Accordingly, a time t1 (time from when the blowing fan 155 starts to be driven to when a sheet P contacts the respective conveyance belts) of the timing chart illustrated in FIG. 12 can be set by taking the area A' as the position A of FIG. 5B in the above-described Embodiment 1.

Each of t1 and t2 has the same meaning as that in each of the above-described embodiments 1 through 4. However, t1 is only set for the driving of the blowing fan 155 since this embodiment does not have the liquid feed pump 182. For t2, this embodiment 4 has the same configuration as the above-described Embodiment 3.

(Embodiment 6)

Next, a cooling conveyor 100 according to an embodiment (Embodiment 6) of this disclosure is described with reference to FIGS. 13A and 13B.

Figure 13A:
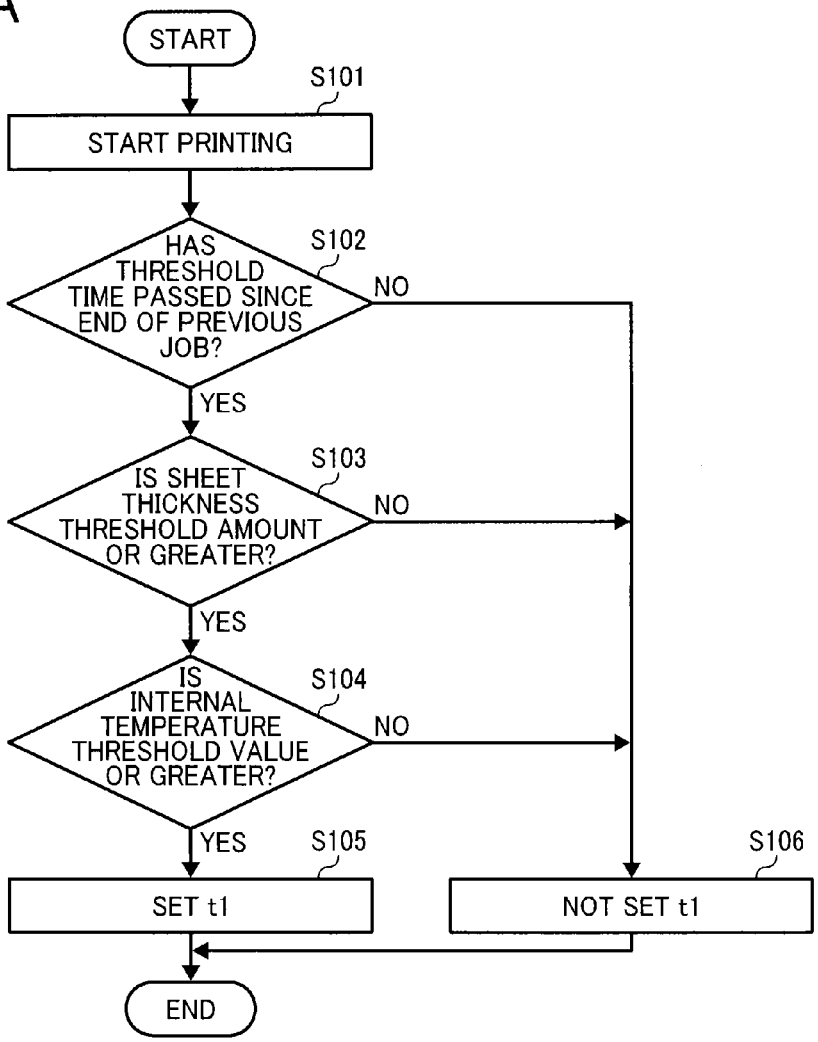
FIG. 13A is a flow chart of determination of whether preliminary cooling operation is to be performed without detecting the temperature of a cooling member of a cooling conveyor according to an embodiment (Embodiment 6) of this disclosure.
Figure 13B:
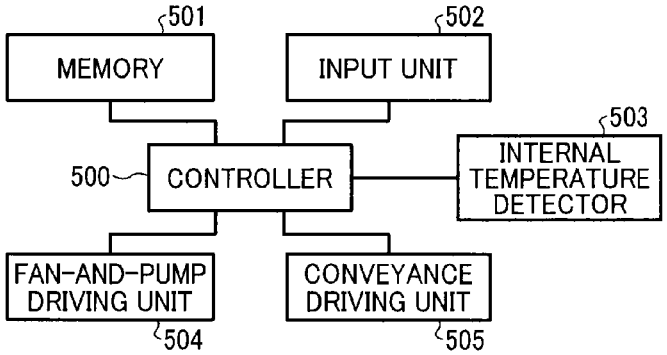
FIG. 13B is a block diagram of a controller and other devices to perform the determination and control the cooling conveyor.

FIGS. 13A and 13B shows an example of control to determine whether the preliminary cooling operation is to be performed without detecting the temperature of a cooling member serving as a cooling unit in this embodiment. FIG. 13A is a flow chart of determination of whether the preliminary cooling operation is to be performed without detecting the temperature of the cooling member. FIG. 13B is a block diagram of a controller 500 and other devices of the image forming apparatus 300 to perform the determination and control the cooling conveyor 100. This embodiment differs from the above-described Embodiments 1 through 5 in that the control is performed to determine whether to perform the preliminary cooling operation in which t1 or t2 is set before a sheet P contacts respective conveyance belts described in the above-described Embodiments 1 through 5. Therefore, configurations, actions, operations, and effects similar to those of the above-described Embodiment 1, 2, 3, 4, or 5 are omitted below for simplicity.

In this embodiment, when print is started (restarted) from a standby state (S101: when print instruction information is received from an input unit 502), at S102 the controller 500 determines whether a certain (predetermined) threshold time has elapsed from a job precedent to a start of the standby state to the start of printing (restart of printing operation). An end time at which the job precedent to the start of the standby state ends is stored on a memory 501 and an elapsed time can be calculated by comparing the end time with a start time of the printing.

If the elapsed time is not longer than the certain (predetermined) threshold time (NO at S102), at S106 the controller 500 does not set t1. This is because the amount of heat at which the cooling member 140 or the respective conveyance belts receive from the fixing device 15 is small in a short standby time. If the elapsed time is longer than the certain (predetermined) threshold time (YES at S102), at S103 the controller 500 determines whether the thickness of a sheet in the job precedent to the start of the standby state is a certain (predetermined) threshold value or greater. As the thickness of the sheet is greater, the controller 500 sets a greater heat capacity of the fixing device 15. Accordingly, if the thickness is the certain threshold value or greater (YES at S103), at S104 the controller 500 determines whether the internal temperature of the image forming apparatus 300 is a certain (predetermined) threshold value or greater. By contrast, if the thickness is smaller than the certain threshold value (NO at S103), heat from the fixing device 15 little affects since the fixing device 15 is not heated to high temperature. Accordingly, in this case, the controller 500 does not set t1 (S106).

In any type of cooling unit, as the internal temperature is higher, the cooling effect decreases. Hence, if the internal temperature is a certain threshold value or greater (YES at S104), the controller 500 sets t1 (S105). By contrast, even in a case in which the thickness of the sheet is the certain threshold value or greater, if the value of the internal temperature is lower than the certain threshold value, the cooling effect is enhanced, thus obtaining sufficient cooling effect. Accordingly, in this case, the controller 500 does not set t1 (S106).

For such a control, t1 can be set only under a condition in which, in particular, t1 needs to be set, and a fan-and-pump driving unit 504 illustrated in FIG. 13B is driven to perform preliminary cooling, thus achieving power saving. An internal temperature detector 503 to detect the internal temperature of the image forming apparatus 300 may also serve as a temperature detector for other device requiring temperature control. Thus, it is not necessary to separately provide a cooling temperature detector to detect the temperature of the cooling member 140 or any of the respective conveyance belts, in other words, the cooling temperature, thus reducing the cost of necessary configuration.

For the cooling conveyor 100 according to this embodiment, as described above, when the standby time in which the cooling member 140 or the respective conveyance belts receive heat from the fixing device 15 is shorter than the certain threshold time and the cooling member 140 or the respective conveyance belts are not heated to high temperature, the preliminary cooling operation can be omitted. By contrast, when the standby time is longer than the certain threshold time and the cooling member 140 or the respective conveyance belts are heated to high temperature, the preliminary cooling operation is performed. Thus, the image forming apparatus 300 can be controlled so as to efficiently perform the preliminary cooling operation of the cooling conveyor 100. In addition, suppression of a reduction in the productivity of the image forming apparatus 300 or facilitation of power saving can be achieved with sufficient cooling of a sheet P thermally fixed first after a shift from the standby state to print operation.

As the thickness of the sheet P is greater, heating and fixing are performed by setting a greater heat capacity of the fixing device 15. Accordingly, as the thickness of the sheet P is smaller, the amount of heat which the cooling member 140 or the respective conveyance belts receive is smaller. By contrast, as the thickness of the sheet P is greater, the amount of heat which the cooling member 140 or the respective conveyance belts receive is greater. Hence, when the thickness of the sheet P is smaller than the certain threshold value and the cooling member 140 or the respective conveyance belts are not at high temperature, the preliminary cooling operation can be omitted. By contrast, when the thickness of the sheet P is greater than the certain threshold value and the cooling member 140 or the respective conveyance belts are heated to high temperature, the preliminary cooling operation is performed. Thus, such a configuration can control the image forming apparatus 300 to more efficiently perform the preliminary cooling operation of the cooling conveyor 100. In addition, such a configuration can facilitate power saving of the image forming apparatus 300 while suppressing a reduction in the productivity of the image forming apparatus 300.

In addition, as the temperature of the internal or external environment of the apparatus body 200 is lower, the effect of decreasing the temperature of the cooling member 140 with the external radiator 180, in other words, the cooling effect of the cooling conveyor 100 is enhanced and the temperature of the cooling member 140 or the respective conveyance belts is decreased. Hence, when a temperature detected with the internal temperature detector 503 is lower than the certain threshold value and the cooling member 140 or the respective conveyance belts are not at high temperature, the preliminary cooling operation can be omitted. By contrast, when a temperature detected with the internal temperature detector 503 is higher than the certain threshold value and the cooling member 140 or the respective conveyance belts are at high temperature, the preliminary cooling operation is performed. Thus, such a configuration can control the image forming apparatus 300 to more efficiently perform the preliminary cooling operation of the cooling conveyor 100. In addition, such a configuration can facilitate power saving of the image forming apparatus 300 while suppressing a reduction in the productivity of the image forming apparatus 300.

(Embodiment 7)

Next, a cooling conveyor 100 according to an embodiment (Embodiment 7) of this disclosure is described with reference to FIGS. 14A and 14B.

Figure 14A:
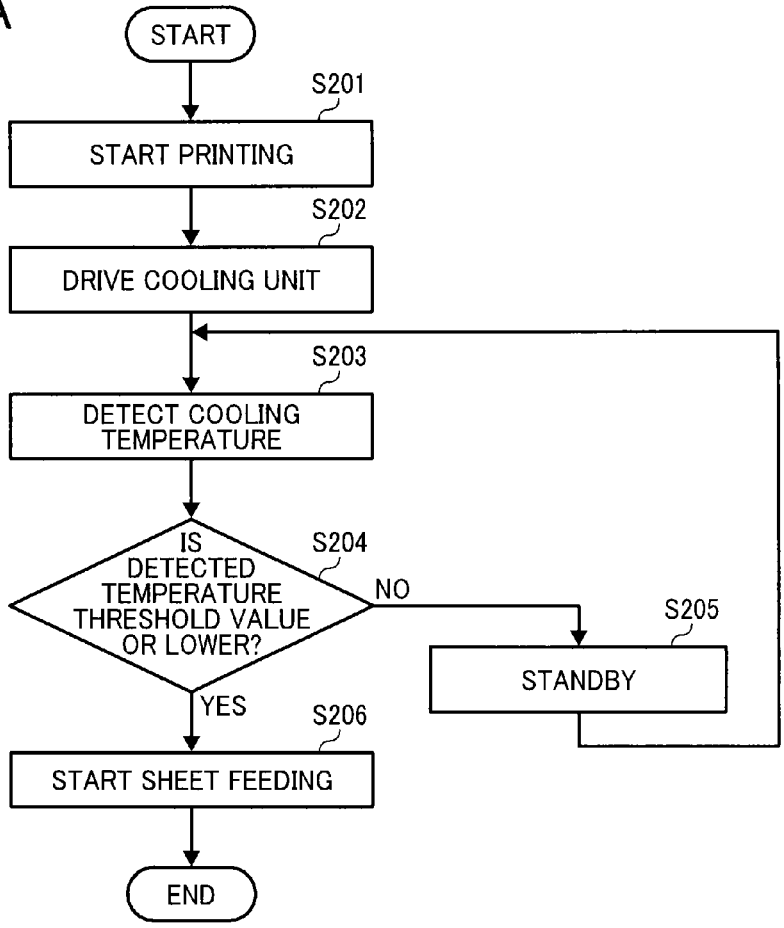
FIG. 14A is a flow chart of control to perform preliminary cooling operation based on a value obtained from temperature detection in a cooling conveyor according to an embodiment (Embodiment 7) of this disclosure.
Figure 14B:
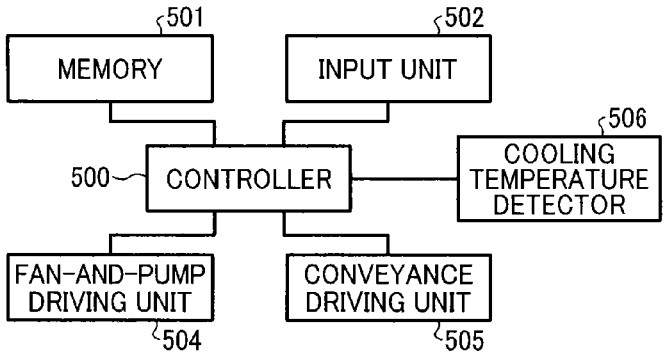
FIG. 14B is a block diagram of a controller and other devices to control the preliminary cooling operation based on the value obtained from the temperature detection.

FIGS. 14A and 14B show an example of control according to this embodiment to perform the preliminary cooling operation based on a value obtained from detection of the temperature of the cooling member 140 or the respective conveyance belts. FIG. 14A is a flow chart of control to perform the preliminary cooling operation based on a value obtained from the temperature detection. FIG. 14B is a block diagram of a controller 500 and other devices of the image forming apparatus 300 to control the preliminary cooling operation based on the value obtained from the temperature detection. This embodiment differs from the above-described Embodiments 1 through 6 in that the preliminary cooling operation is controlled based on a value obtained by detecting the temperature of the cooling member 140 or the respective conveyance belts, that is, the cooling temperature of the cooling member 140 or the respective conveyance belts. Therefore, configurations, actions, operations, and effects similar to those of the above-described Embodiment 1, 2, 3, 4, 5, or 6 are omitted below for simplicity.

In this embodiment, a cooling temperature detector 506 to detect cooling temperature of the cooling member 140 or any of the respective conveyance belts is provided for detecting the temperature of a target portion of the temperature control. For example, when the target portion is the position A of the cooling member illustrated in FIG. 5, the cooling temperature detector 506 detects the temperature of the position A. In this embodiment, when print is started (restarted) from a standby state (S201: when print instruction information is received from an input unit 502), at S202 the controller 500 activates the cooling unit by driving a fan-and-pump driving unit 504 illustrated in FIG. 14B to activate the cooling unit. At S203, the cooling temperature detector 506 detects a cooling temperature of the control target position in each of the above-described Embodiments. At S204, the controller 500 determines whether or not the temperature of the position is a certain threshold value or lower, that is, the above-described target temperature. If the temperature of the position is higher than a certain threshold value (No at S204), the controller 500 is on standby for a certain time (S205) and repeats the determination process of S203 and S204 until the condition that the temperature of the position is the certain threshold value or lower is satisfied. By contrast, if the temperature of the position is the certain threshold value or lower (YES at S204), at S206 the controller 500 starts a sheet feeding process.

Such a control allows sheet feeding to be stopped until the temperature of a contact portion is a certain threshold value or lower, thus allowing reliable cooling. In addition, for example, even when the cooling performance of, e.g., the external radiator 180 is reduced due to some reason, such a control can prevent insufficient cooling of the sheet P after fixing by heat. It is to be noted that the activation of the cooling unit is not limited to a step after the start of printing. For example, when it is determined that t1 is set (S105) in FIG. 13A, the controller 500 may activate the cooling unit (S202) and continue the following steps of FIG. 14A.

The above-descriptions relate to limited examples, and the present disclosure includes, e.g., the following aspects giving respective effects described below.

(Aspect A)

An image forming apparatus includes a cooling conveyor, such as the cooling conveyor 100, to cool a recording material, such as the sheet P, having an image fixed by heat while sandwiching and conveying the recording material. The cooling conveyor includes a belt conveyance assembly constituted of, e.g., the front-side sandwiching part 160 and the back-side sandwiching part 170. The belt conveyance assembly includes a conveyance belt, such as the front-side conveyance belt 161, to sandwich and convey the recording material. The cooling conveyor also includes a cooling member, such as the cooling member 140, to absorb heat of the recording material via the conveyance belt and a cooling unit, such as the external radiator 180, to maintain the cooling member at low temperature. The cooling conveyor performs control of stopping the cooling unit in a standby state of the image forming apparatus, activating the cooling unit and performing a preliminary cooling operation to decrease temperature of the cooling member after a shift from the standby state to image forming operation, and then bringing the recording material into contact with the conveyance belt.

Such a configuration gives, for example, the following effect as described in the above-described Embodiment(s) 1 (through 7). In other words, when the image forming apparatus is on standby, driving of the cooling unit of the cooling conveyor is stopped, thus contributing power saving of the image forming apparatus. In addition, since the preliminary cooling operation is performed to decrease the temperature of the cooling member, the temperature of a contact portion of the conveyance belt with the cooling member can be decreased even if the cooling member or the conveyance belt is at high temperature during standby of the image forming apparatus. Accordingly, a large temperature difference can be obtained between the recording material having an image fixed by heat and each of the conveyance belt contacting the recording material and the cooling member absorbing heat of temperature difference via the conveyance belt. Such a configuration can suppress a reduction in cooling performance of the cooling conveyor in a shift from the standby state to image forming operation. Thus, in Aspect A, an image forming apparatus can be provided that can perform sufficient cooling with a reduced power consumption of the cooling conveyor while sandwiching and conveying a recording material having an image fixed be heating, even if the recording material is a recording material on which an image is first fixed by heat after a shift from the standby state to image forming operation.

(Aspect B)

In Aspect A, a time of the preliminary cooling operation started before the recording material contacts the conveyance belt, such as the front-side conveyance belt 161 or the back-side conveyance belt 171, is a driving time of the cooling unit, such as the external radiator 180, for decreasing the temperature of the cooling member, such as the cooling member 140, to a target temperature. As described in the above-described Embodiment(s) 1 (through 7), in the preliminary cooling operation performed before the recording material is brought into contact with the conveyance belt, the recording material can be preliminarily reduced to a target temperature at which the recording material can be sufficiently cooled. Accordingly, such a configuration can reliably suppress a reduction in cooling performance of the cooling conveyor, such as the cooling conveyor 100, on a shift from a standby state to image forming operation, such as the start of printing.

(Aspect C)

In Aspect A or B, the preliminary cooling operation, in which the external radiator 180 is driven to decrease the temperature of the cooling member 140 before the sheet P contacts the front-side conveyance belt 161 or the back-side conveyance belt 171, includes an operation of driving the belt conveyance assembly constituted of, e.g., the front-side sandwiching part 160 and the back-side sandwiching part 170, for a certain time to preliminarily decrease temperature of a high-temperature portion of the conveyance belt. Such a configuration gives, for example, the following effect as described in the above-described Embodiment(s) 3 (through 7). By preliminary cooling operation performed before the recording material, such as the sheet P, is brought into contact with the conveyance belt, the temperature of a high-temperature portion of the conveyance belt can be preliminarily decreased, thus further suppressing a reduction in cooling performance of the cooling conveyor in a shift from a standby state to image forming operation.

(Aspect D)

In Aspect C, driving of the belt conveyance assembly constituted of, e.g., the front-side sandwiching part 160 and the back-side sandwiching part 170, is started during a time t1 during which the cooling unit, such as the external radiator 180, is driven to decrease the temperature of the cooling member, such as the cooling member 140. Such a configuration gives, for example, the following effect as described in the above-described Embodiment(s) 3 (through 7). Since driving of the belt conveyance assembly is started while the cooling unit is driven to decrease the temperature of the cooling member, the conveyance belt, such as the front-side conveyance belt 161, can be brought into contact with the cooling member which starts to decrease in temperature, thus effectively decreasing the temperature of the conveyance belt.

(Aspect E)

In Aspect A, B, C, or C, the cooling unit, such as the external radiator 180, is a liquid cooling system. The cooling unit includes a radiator, such as the radiator 181, and a flow channel, the flow channel 122, disposed in the cooling member, such as the cooling member 140, through which a cooling liquid flows. The cooling unit also includes an external flow channel, such as the rubber tube 184, connecting an outlet of a component member disposed at an upstream side and an inlet of a component member disposed at a downstream side in a flowing direction of the cooling liquid. The cooling liquid flows through the external flow channel. The cooling unit further includes a liquid feed unit, such as a liquid feed pump 182, to circulate the cooling liquid between an internal channel of the radiator and the flow channel of the cooling member and transfer heat of the recording material, such as the sheet P, absorbed by the cooling member to the radiator for radiation.

Such a configuration gives, for example, the following effect as described in the above-described Embodiment(s) 1 (through 7). Since the cooling unit employs a liquid cooling system, the temperature of the cooling member absorbing heat of the recording material, such as the sheet P, via the conveyance belt, such as the front-side conveyance belt 161, can be more efficiently decreased than an air cooling system employing, e.g., the air-cooling heat sinks 150 as the cooling member. Accordingly, such a configuration can reduce the time required for the preliminary cooling operation and more effectively suppress a reduction in cooling performance of the cooling conveyor on a shift from the standby state to image forming operation, such as a start of printing, than a cooling conveyor employing an air cooling system. In addition, such a configuration can finish preliminary cooling operation during warm-up of a heating member, such as a heater, of a fixing device, such as the fixing device 15. Accordingly, even a recording material on which an image is first fixed by heat after a shift from the standby state to image forming operation, such a configuration can sufficiently cool the recording material without reducing the productivity of the image forming apparatus.

(Aspect F)

In Aspect E, the external flow channel, such as the rubber tube 184, directly connects an outlet of the internal channel of the radiator, such as the radiator 181, to an inlet of the flow channel, such as the flow channel 122, of the cooling member, such as the cooling member 140. As described in the above-described Embodiment(s) 1 (through 7), such a configuration allows the cooling liquid to be supplied to the flow channel of the cooling member immediately after the cooling liquid is cooled by the radiator, thus shortening the time required for decreasing the temperature of the cooling member to a desired temperature. Accordingly, in a shift from the standby state to image forming operation, such a configuration can more reduce the time required for preliminary cooling operation than a configuration in which a component member of other liquid cooling type is disposed between the radiator and the cooling member.

(Aspect G)

In Aspect E or F, the flow channel, such as the flow channel 122, of the cooling member, such as the cooling member 140, is arranged to flow the cooling liquid from a downstream side to an upstream side in a transport direction of the recording material. The cooling conveyor, such as the cooling conveyor 100, performs control of bringing the recording material into contact with the conveyance belt, such as the front-side conveyance belt 161 or the back-side conveyance belt 171, after decreasing temperature of a most upstream end, such as the position A, of the cooling member in the transport direction of the recording material. Such a configuration gives, for example, the following effect as described in the above-described Embodiment(s) 4 (through 7). In addition, in absorbing heat from the recording material, such as the sheet P, via the conveyance belt by the cooling member, such a configuration can more effectively decrease the temperature of the conveyance belt contacting the cooling surface at the most upstream end of the cooling member in the sheet transport direction, than a different configuration. Accordingly, such a configuration can more reduce the time required for preliminary cooling operation of the cooling conveyor in a shift from the standby state to image forming operation, such as the start of printing than a different configuration, and can enhance cooling performance of the cooling conveyor in continuously cooling sheets.

(Aspect H)

In Aspect E or F, the flow channel, such as the flow channel 122, of the cooling member, such as the cooling member 140, is arranged to flow the cooling liquid from an upstream side to a downstream side in a transport direction of the recording material. The cooling conveyor, such as the cooling conveyor 100, performs control of bringing the recording material, such as the sheet P, into contact with the conveyance belt, such as the front-side conveyance belt 161 or the back-side conveyance belt 171, after decreasing temperature of a most downstream end, such as the position B, of the cooling member in the transport direction of the recording material. As described in the above-described Embodiments 2 (or 4), in absorbing heat from the recording material, such as the sheet P, via the conveyance belt by the cooling member, such a configuration can decrease the temperature of the conveyance belt contacting the cooling surface at the most downstream end of the cooling member in the sheet transport direction, to a desired target temperature. Accordingly, even in the configuration in which the flow channel of the cooling member is formed so as to flow the cooling liquid from the upstream side to the downstream side in the sheet transport direction, such a configuration can sufficiently cool a recording material first fixed by heat after a shift from a standby state to image forming operation.

(Aspect I)

In Aspect A, B, C, D, E, F, G, or H, when, on a shift to image forming operation, a threshold time has passed from a stop of driving of the belt conveyance assembly constituted of, e.g., the front-side sandwiching part 160 and the back-side sandwiching part 170, in a precedent image formation such as precedent print operation, the cooling conveyor, such as the cooling conveyor 100, performs control of performing the preliminary cooling operation and then bringing the recording material, such as the sheet P, into contact with the conveyance belt, such as the front-side conveyance belt 161 or the back-side conveyance belt 171.

Accordingly, as described in the above-described Embodiment 6, when the standby time in which the cooling member or the conveyance belt receive heat from the fixing device, such as the fixing device 15, is shorter than a threshold time and the cooling member, such as the cooling member 140, or the conveyance belt is not at high temperature, the preliminary cooling operation can be omitted. By contrast, when the standby time is longer than the certain threshold time and the cooling member or the conveyance belt is at high temperature, the preliminary cooling operation is performed. Thus, the image forming apparatus, such as the image forming apparatus 300, can be controlled so as to efficiently perform the preliminary cooling operation of the cooling conveyor, such as the cooling conveyor 100. In addition, suppression of a reduction in the productivity of the image forming apparatus or facilitation of power saving can be achieved with sufficient cooling of a recording material on which an image is first fixed by heat after a shift from the standby state to image forming operation.

(Aspect J)

In Aspect I, when the thickness of the recording material on which the precedent image formation is performed is a threshold value or greater, the cooling conveyor performs the control of performing the preliminary cooling operation and then bringing the recording material into contact with the conveyance belt, such as the front-side conveyance belt 161 or the back-side conveyance belt 171.

As described in the above-described Embodiment 6, as the thickness of the recording material is greater, heating and fixing are performed by setting a greater heat capacity of the fixing device, such as the fixing device 15. Accordingly, as the thickness of the recording material is smaller, the amount of heat which the cooling member or the conveyance belt receives is smaller. By contrast, as the thickness of the recording material is greater, the amount of heat which the cooling member or the conveyance belt receives is greater. Hence, when the thickness of the recording material is smaller than a certain threshold value and the cooling member or the conveyance belt is not at high temperature, the preliminary cooling operation can be omitted. By contrast, when the thickness of the recording material is greater than the certain threshold value and the cooling member or the conveyance belt is at high temperature, the preliminary cooling operation is performed. Thus, such a configuration can control the image forming apparatus to more efficiently perform the preliminary cooling operation of the cooling conveyor. In addition, such a configuration can more facilitate power saving of the image forming apparatus while suppressing a reduction in the productivity of the image forming apparatus, than Aspect I.

(Aspect K)

In Aspect J, the image forming apparatus further includes an environmental temperature detector, such as the internal temperature detector 503, to detect the temperature of an internal environment, such as an interior of the apparatus body 200, or an external environment of the image forming apparatus, such as the image forming apparatus 300. When the temperature detected with the environmental temperature detector is a threshold value or greater, the cooling conveyor performs the control of performing the preliminary cooling operation and then bringing the recording material, such as the sheet P, into contact with the conveyance belt, such as the front-side conveyance belt 161 or the back-side conveyance belt 171.

Such a configuration gives the following effect as described in the above-described exemplary Embodiment 6. In addition, as the temperature of the internal or external environment of the image forming apparatus is lower, the effect of decreasing the temperature of the cooling member, such as the cooling member 140, with the cooling unit, such as the external radiator 180, in other words, the cooling effect of the cooling conveyor, such as the cooling conveyor 100, is enhanced and the temperature of the cooling member or the conveyance belt is decreased. Hence, when the temperature detected with the environmental temperature detector is lower than the certain threshold value and the cooling member or the conveyance belt is not at high temperature, the preliminary cooling operation can be omitted. By contrast, when the temperature detected with the environmental temperature detector is higher than the certain threshold value and the cooling member or the conveyance belt is at high temperature, the preliminary cooling operation is performed.

Thus, such a configuration can control the image forming apparatus, such as the image forming apparatus 300, to more efficiently perform the preliminary cooling operation of the cooling conveyor. In addition, such a configuration can more facilitate power saving of the image forming apparatus while suppressing a reduction in the productivity of the image forming apparatus, than Aspect J.

(Aspect L)

In Aspect A, B, C, D, E, F, G, H, I, J, or K, the image forming apparatus further includes a cooling-member temperature detector, such as the cooling temperature detector 506, to detect the temperature of the cooling member, such as the cooling member 140, or a portion adjacent to the cooling member. After the preliminary cooling operation is started and the temperature detected with the cooling-member temperature detector is a threshold value or lower, the cooling conveyor performs control of bringing the recording material, such as the sheet P, into contact with the conveyance belt, such as the front-side conveyance belt 161 or the back-side conveyance belt 171. Accordingly, as described in the above-described Embodiment 7, the cooling conveyor performs control of continuing preliminary cooling operation until the temperature detected with the cooling-member temperature detector is not greater than a threshold value, in other words, the temperature of a target portion for temperature control becomes a target temperature value. Thus, the image forming apparatus can perform control of not feeding a recording material until the temperature of a target portion for temperature control becomes a target temperature value, and can reliably perform sufficient cooling of the recording material even when the cooling performance of the cooling unit, such as the external radiator 180, is reduced due to some reason.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a cooling conveyor to convey and cool a recording material having an image fixed by heat while the recording material is pressed against the cooling conveyor, the cooling conveyor including a conveyance belt to convey the recording material, a heat absorber to absorb heat of the recording material via the conveyance belt, and a cooler to maintain the heat absorber at a reduced temperature, the image forming apparatus further comprising a controller to control stopping of the cooler in a standby state of the image forming apparatus, activating the cooler and performing a preliminary cooling operation to decrease a temperature of the heat absorber after a shift from the standby state to an image forming operation, and subsequently causing the recording material to contact the conveyance belt, wherein the cooler is a liquid cooling system and includes a radiator, an external flow channel connecting an outlet of the heat absorber and an inlet of the heat absorber to the cooler, and a pump to circulate a cooling liquid through the radiator, external flow channel, and the heat absorber to transfer heat of the recording material absorbed by the heat absorber to the radiator for radiation, wherein a flow channel of the heat absorber is configured to flow the cooling liquid from an upstream side of the heat absorber to a downstream side of the heat absorber in a transport direction of the recording material, and wherein the controller performs control of bringing the recording material into contact with the conveyance belt after decreasing temperature of a most downstream end of the heat absorber in the transport direction of the recording material.

2. The image forming apparatus according to claim 1, wherein a time of the preliminary cooling operation started before the recording material contacts the conveyance belt is a driving time of the cooler for decreasing the temperature of the heat absorber to a target temperature.

3. The image forming apparatus according to claim 1, wherein the preliminary cooling operation includes an operation of driving the conveyance belt for a certain time to preliminarily decrease a temperature of a high-temperature portion of the conveyance belt that has a temperature higher than other portions of the conveyance belt.

4. The image forming apparatus according to claim 3, wherein the driving of the conveyance belt is started while the cooler is operated to decrease the temperature of the heat absorber.

5. The image forming apparatus according to claim 1, wherein the external flow channel directly connects an outlet of the heat absorber to an inlet of the radiator.

6. The image forming apparatus according to claim 1, further comprising a heat absorber temperature detector to detect a temperature of the heat absorber or a portion adjacent to the heat absorber, wherein after the preliminary cooling operation is started and the temperature detected with the heat absorber temperature detector is a threshold value or lower, the controller causes bringing the recording material into contact with the conveyance belt.

7. The image forming apparatus according to claim 1, wherein the heat absorber comprises a plurality of physically separated heat absorbers.

8. An image forming apparatus, comprising:

a cooling conveyor to convey and cool a recording material having an image fixed by heat while the recording material is pressed against the cooling conveyor, the cooling conveyor including a conveyance belt to convey the recording material, a heat absorber to absorb heat of the recording material via the conveyance belt, and a cooler to maintain the heat absorber at a reduced temperature, the image forming apparatus further comprising a controller to control stopping of the cooler in a standby state of the image forming apparatus, activating the cooler and performing a preliminary cooling operation to decrease a temperature of the heat absorber after a shift from the standby state to an image forming operation, and subsequently causing the recording material to contact the conveyance belt, wherein after a shift from a standby state to an image forming operation and a threshold time has passed after driving of the conveyance belt in a precedent image formation operation, the controller causes performing the preliminary cooling operation and then causes bringing the recording material into contact with the conveyance belt.

9. The image forming apparatus according to claim 8, wherein when a thickness of the recording material on which the precedent image formation is performed is a threshold value or greater, the controller causes the preliminary cooling operation and then causes bringing the recording material into contact with the conveyance belt.

10. The image forming apparatus according to claim 9, further comprising:

an environmental temperature detector to detect a temperature of an internal environment or an external environment of the image forming apparatus, wherein when the temperature detected with the environmental temperature detector is a threshold value or greater, the controller causes performing the preliminary cooling operation and then causes bringing the recording material into contact with the conveyance belt.

11. An image forming apparatus, comprising:

a conveyor including a conveyance belt which in a loop, the conveyance belt to convey recording material;

a controller; and a cooling device including:

a cooler within the loop of the conveyance belt to cool the recording material which has an image thereon which has been fixed by heat, a pump to circulate a liquid in the cooling device, and a radiator to radiate the liquid discharged from the cooler, wherein the controller controls the pump to activate the pump after receiving an instruction to start a job, and stop the pump after the conveyor is stopped, wherein the cooler includes an inlet and an outlet shifted from the inlet in a conveyance direction, and wherein the liquid exiting the radiator flows directly to the inlet of the cooler.

12. The image forming apparatus according to claim 11, wherein:

the conveyor includes a drive roller to rotate the conveyance belt, and the controller stops the pump after the driver roller of the conveyor is stopped.

13. The image forming apparatus according to claim 11, wherein:

the conveyor includes a drive roller to rotate the conveyance belt, and the controller starts a driving of the drive roller after activating the pump.

14. The image forming apparatus according to claim 11, wherein:

the cooling device includes a tank and a fan to cool the liquid passing through the radiator, and the outlet of the cooler, the tank, the pump, the radiator, and the inlet of the cooler are disposed in this order in a direction in which the liquid flows.

* * * * *